United States Patent [19]

Schmidgall

[11] Patent Number: 4,673,159

[45] Date of Patent: Jun. 16, 1987

[54] MOLDING FORMS FOR MAKING PRECAST PORTAL ASSEMBLY SECTIONS FOR CULVERTS

[75] Inventor: Eugene D. Schmidgall, Hancock, Minn.

[73] Assignee: Hancock Concrete Products Co., Inc., Hancock, Minn.

[21] Appl. No.: 662,260

[22] Filed: Oct. 18, 1984

[51] Int. Cl.[4] ..... B28B 7/30

[52] U.S. Cl. ..... 249/159; 249/12; 249/27; 249/102; 249/123; 249/160; 249/184; 249/209

[58] Field of Search ..... 249/10, 11, 12, 14, 249/27, 102, 123, 144, 155, 157, 158, 159, 160, 175, 184, 194, 209

[56] References Cited

U.S. PATENT DOCUMENTS

| | | | |
|---|---|---|---|
| 3,701,508 | 10/1972 | Cross | 249/129 |
| 3,767,153 | 10/1973 | Haller et al. | 249/158 |
| 4,023,764 | 5/1977 | Clements | 249/27 |
| 4,127,254 | 11/1978 | Kahan | 249/27 |
| 4,219,513 | 8/1980 | Miller | 249/11 |

FOREIGN PATENT DOCUMENTS

| | | | |
|---|---|---|---|
| 2241981 | 3/1975 | France | 249/209 |
| 8302974 | 9/1983 | PCT Int'l Appl. | 249/48 |

*Primary Examiner*—Jay H. Woo
*Assistant Examiner*—James C. Housel
*Attorney, Agent, or Firm*—Dorsey & Whitney

[57] ABSTRACT

Molding forms for precast concrete portal assemblies are described. The molding forms include adjustable form surfaces for precasting different shaped portal assemblies from the same basic mold. The molding forms herein are particularly designed for molding portal assemblies for use at either or both end of box culverts which provide passages extending under a longitudinal embankment at skew angles rather than transversely perpendicular to the embankment access.

10 Claims, 30 Drawing Figures

MOLDING FORMS FOR MAKING PRECAST PORTAL ASSEMBLY SECTIONS FOR CULVERTS

BACKGROUND OF THE INVENTION

Box-type and cylindrical culvert constructions are known, in which the main culvert portion provides a bottom wall, side walls and a top wall for a generally-crosswise passage (such as a stream passage or path or roadway) under an embankment which extends along a longitudinal axis (e.g., of a road on top of the embankment). Such embankments normally have a laterally outwardly and downwardly inclined fill slope at each side, through which some sort of portal construction is adapted to project from one end of the main culvert body. Such a fill slope defines a fill slope plane with a desired vertical fill slope angle, as measured in a vertical plane perpendicular to the longitudinal embankment axis.

In prior culvert arrangements in which the culvert defines a passage extending transversely through the embankment in a vertical plane perpendicular to the longitudinal embankment axis, portal constructions are known, as shown in Hewett U.S. Pat. No. 1,144,200, and in Odendahl U.S. Pat. No. 2,263,588, for use with a main culvert body portion which includes a series of individual tubular or box-like sections assembled in end-to-end relationship to each other to define the desired main culvert passage. The precast portal members of such patents provide continuing bottom and side wall portions for direct connection at one end of the culvert. In these cases, the upper edges of the portal side walls extend symmetrically outwardly and downwardly from the culvert end at identical vertical angles which fit the desired fill slope plane. In such prior patents the side walls also flare symmetrically outwardly with reference to such a transverse vertical plane perpendicular to the longitudinal embankment axis. In another previously-known type of portal assembly, a precast portal end section, for direct connection at one end of such a main culvert passage extending perpendicularly across such an embankment axis, has been provided with a bottom wall and integral side walls which extend symmetrically away from the culvert end in vertical planes parallel to each other and also perpendicular to the embankment axis.

There is a problem, however, in providing a portal construction at the outer end of a culvert, when the culvert extends crosswise through the embankment at an acute skew angle with respect to such a transverse vertical plane. For example, if a symmetrical portal section of the type shown in the above patents is attached directly as a normal extension at one end of such a skewed culvert, the respective upper edges of the side walls would not both match the fill slope plane.

In prior constructions, it has accordingly been customary to construct molding forms for such a portal section on the site of culvert installation, and to form individual portal side walls on the site, where the upper edges of such forms can be constructed unsymmetrically to individually match the desired fill slope plane. In such cases, such side walls have been cast as separate wings of such a portal, either on top of a previous on-site casting for a portal base, or with subsequent on-site casting of such a portal base portion in between the on-site castings for the individual side walls or wings of the portal.

Such on-site construction of portals makes it necessary to have skilled personnel crews at the site to make the necessary forms, and successively cast and finish the various elements of such a portal. Such operations accordingly involve extra cost and time, particularly when it is necessary to use such construction methods for on-site construction of portals for individual culverts which may extend through their respective embankments at a variety of different skew angles, corresponding to the different original directions of the stream or other type of passage involved.

Some efforts have been made to provide preconstructed molds or forms to expedite the casting of culvert walls and/or portal portions, as shown for example by DeLaMare U.S. Pat. Nos. 1,461,973 and 1,560,811, Scott 1,926,633, Odendahl 2,247,517, Holland 3,696,177 and Cast 3,826,460. Some of these prior mold forms are useful only for on-site casting of upper culvert bodies on top of a culvert bottom wall previously poured at such site. None of them provides forms or methods for possible precasting of different portal members which could be used satisfactorily at an outer end of a culvert which extends through its embankment at a skew angle or which could be used satisfactorily for selectively precasting portal members of different shapes for use at the ends of culverts with different skew angles.

SUMMARY OF THE INVENTION

With the above background in mind, the present invention is based on my recognition of a need for new types of precast concrete portal sections for connection at one end or both ends of box-type culverts which extend at various skew angles through longitudinal embankments of the type described, as well as my recognition of a need for improved molds and casting methods for the precasting of such novel portal members, and of some of the prior types of portal members, for subsequent delivery and installation at a specific culvert site, without the need for additional on-site casting for the construction of such members.

With respect to the structure of the portal members, the present invention includes the provision of unsymmetrical precast concrete portal assembly sections, each of which, when installed at one end of a box culvert, has a U-shaped body portion in which the base of the U is adapted to provide a bottom wall for the desired stream or other passage, and in which the arms of the U project upwardly from said base at each side of said bottom wall and are adapted to provide continuing side walls for such a passage. The shape and orientation of such a section provide a body portion which is unsymmetrical with reference to a vertical reference plane perpendicular to the longitudinal embankment axis.

One embodiment of a portal assembly section according to the invention comprises an unsymmetrical portal transition section having a U-shaped body portion, in which the base of the U provides a transversely-extending wedge-shaped bottom transition wall for the stream passage between the bottom wall of one skewed culvert end and the bottom wall of a desired portal end section. The respective arms of the U-shaped body portion of such transition section extend upwardly at each side of said base and provide first and second transition side walls of respectively different horizontal lengths for the stream passage at said culvert end. Such a transition section has a transverse vertical inner end face perpendicular to at least one of its side walls for direct matching connection to an outer end face at one end of a skewed box culvert, and with at least said one transition side wall extending as a continuation of the corresponding box culvert side wall without change in the skew angle of that side of the stream passage. The transition section further has a transverse vertical outer end face in a vertical plane extending angularly across the side walls of the transition section and parallel to the expected longitudinal embankment axis. Preferably the two side walls of such a transition section are parallel to each other and thus maintain the box culvert skew angle at both sides of the stream passage.

The top of such a U-shaped transition section is covered by a wedge shaped lintel beam, which is supported by horizontal upper edges of the two side walls. The lintel beam and side walls have interlocking means for holding the lintel in position, with a vertical inner end face of the lintel having interfitting means for engaging the top of the main culvert end section. The outer end face of the lintel beam is designed to just reach the desired fill slope plane.

Another embodiment of a portal assembly section according to the invention comprises at least one monolithic unsymmetrical precast concrete portal end section which has a U-shaped body portion in which the base of the U, when installed at one end of the desired culvert, or at the outer end of a transition section as just described, provides a portal bottom wall for the stream passage, and in which the arms of the U project upwardly from the base at each side of the bottom wall and are adapted to provide continuing portal side walls of decreasing height for the stream passage. Such portal side walls extend unsymmetrically outwardly through the embankment, with reference to a vertical reference plane perpendicular to the longitudinal embankment axis, and each such side wall has a respective upper edge which slopes downwardly and outwardly at a vertical angle adapted to fit the desired fill slope plane. The unsymmetrical portal end section further has inner and outer end faces parallel to each other and parallel to the expected longitudinal embankment axis.

At least one of the portal side walls accordingly extends outwardly at an acute horizontal angle with a vertical reference plane perpendicular to the longitudinal embankment axis, and the upper edge of said one portal side wall slopes downwardly and outwardly at a smaller vertical angle than the expected fill slope angle and is thereby adapted to fit the fill slope plane. The invention provides for variations in the horizontal angles at which the respective side walls of such an unsymmetrical portal end section extend outwardly with respect to each other. In one embodiment, the side walls of such an unsymmetrical skewed end section may be parallel to each other, but unsymmetrical with respect to such a reference plane.

Thus the invention provides unsymmetrical precast sections for a complete portal assembly in which an unsymmetrical transition section as described is connected between the outer end of a skewed box culvert body and the inner end of a portal member having one or more unsymmetrical portal end sections whose side walls have inclined upper edges which may be of different lengths and angular inclinations to fit a desired common fill slope plane.

If the box culvert is almost transversely perpendicular to the longitudinal embankment axis rather than at a substantial skew angle to such axis, an unsymmetrical transition section may be unnecessary, and the unsymmetrical portal end section may be connected directly to the culvert end, or to an intermediate symmetrical transition section having parallel inner and outer end faces perpendicular to parallel side walls.

In its molding form aspects, the present invention provides a form for selectively precasting either or both of the desired concrete portal end sections and transition sections for a complete portal assembly of the type described. Such a form includes an inner form member with upwardly and outwardly facing top and side mold surfaces corresponding to upside-down images of the inner bottom and side walls of the desired precast section, and at least two outer side wall form members, two bottom form members and two end wall form members, all of which provide an upwardly-facing mold space which corresponds to an upside-down image of the U-shaped body portion of a desired unsymmetrical transition section or unsymmetrical portal end section of the types described herein.

Thus the desired portal sections may be precast initially in upside-down position along the upwardly facing top wall and outwardly facing side wall mold surfaces of such an inner form member, and subsequently removed from the form for later installation at the desired culvert site.

To mold precast portal sections adapted to fit differently skewed culvert body ends, the invention includes the provision of at least one selectively insertable and removable insert section for the upwardly facing top mold wall surface of the inner form. Thus one of the effective shape and width characteristics of the top mold wall surface can be changed as needed to correspond to an upside-down image of different desired shape and width characteristics for the U-shaped body portion which is to be cast in inverted position thereon.

For example the invention provides a plurality of horizontal wedge-shaped insert sections for the upwardly facing mold surface of the inner form member, each having respective side edges diverging outwardly from each other at a different one of the desired possible flare angles for such a portal end or transition section. Connecting means are provided at the respective side edges of such insert sections for selective removable connection of any one of them in the top of the inner form. Means are also provided for correspondingly changing the relative angular orientation of at least one outwardly facing side wall mold surface of the inner form, for selective casting of any selected one of the different desired portal sections.

The invention further provides a longitudinal rectangular mold section insert for such upwardly-facing mold wall of the inner form member, with edge connecting means for use when it is desired to have the outwardly facing inner side wall mold surfaces parallel to each other for casting either a skewed transition section or one or more skewed portal end sections with parallel side walls.

In its method aspects, the invention includes the steps of providing a molding form of the type just described, with an inner form member, outer side wall form members, bottom form members, and end wall form members which define an upwardly open mold space corresponding to an inverted image of all but the outer bottom surface of the base of the desired portal end or transition section, pouring a suitable concrete mix downwardly into such upwardly open mold space, continuing to pour such concrete mix into the form until it covers the upwardly facing top surface of the inner form member to a depth corresponding to a desired thickness for the base of the desired U-shaped body portion, finishing the upper surface of the poured concrete mix to a shape corresponding to an upside-down image of the outer bottom wall surface of the desired U-shaped body portion, thereby forming the U-shaped body portion as an integral precast unit in an upside-down orientation, and subsequently removing the precast body portion for inversion to right-side-up position and for installation at the desired culvert end.

The method includes variations in which the side wall mold surfaces of the inner mold member can be selectively positioned parallel to each other or at one or more desired flare angles, such as 15° or 30°. When the side wall form members are parallel, the method provides for the pouring of an unsymmetrical angular transition section at one end of the form and for the possible pouring of unsymmetrical skewed portal end sections with parallel side walls at the remaining portions of the form.

When the method involves the positioning of the side wall form members at a desired flare angle, with the correspondingly appropriate wedge-shaped insert in the upper wall of the inner form member, the invention provides a method for casting one or more unsymmetrical portal end sections in which the side walls are oriented at an acute angle with respect to each other. More specifically, this portion of the method also includes the possible casting of three portal end sections designed for ultimate end-to-end assembly with each other, in which the first portal section is initially cast at the narrow end of the form, the third section is cast at a spaced location toward the wider end of the form, leaving an open area between the first and third sections which is exactly equal in length to the area required for the desired intermediate or second section, removing the first and third sections from the form and rearranging or replacing the necessary end wall and bottom wall form members, and thereafter casting the second or intermediate portal end section in what was formerly the open area between the first and third section casting areas.

Further details and advantages of the different aspects of the invention which involve the unsymmetrical precast portal end sections and unsymmetrical precast portal transition sections, as well as the forms and methods for precasting such sections will be apparent from the following description, in which the preferred embodiments of the invention are described.

BRIEF DESCRIPTION OF THE DRAWINGS

In the drawings which form a part of this application, and in which like reference characters indicate like parts.

DESCRIPTION OF THE PREFERRED EMBODIMENTS

Figure 1:
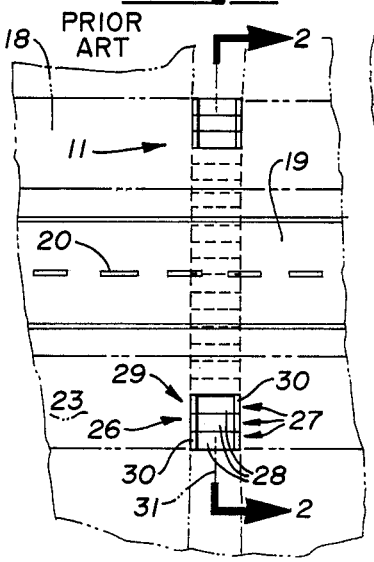
FIG. 1 is a top plan view of a roadway with a prior art box culvert running beneath it along a reference plane perpendicular to the longitudinal embankment axis.
Figure 2:
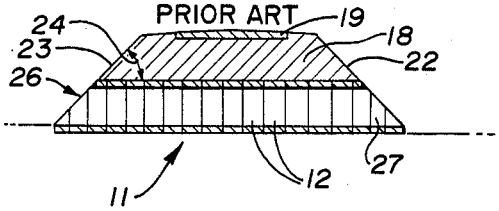
FIG. 2 is a cross sectional view taken along reference plane line 2—2 of FIG. 1.
Figure 3:
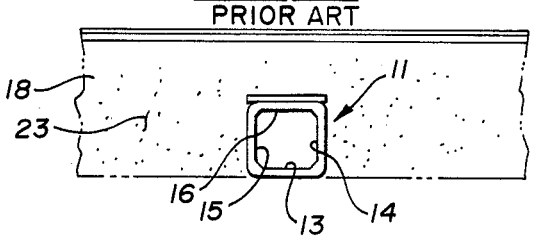
FIG. 3 is a side elevational view of the roadway and culvert of FIG. 1.

FIGS. 1, 2 and 3 show a previously known type of box culvert and portal construction, as discussed in the initial background portion of this application. A box culvert 11 is constructed by assembly of plural box sections 12, which provide a bottom wall 13, side walls 14 and 15, and a top wall 16 for a desired passage, such as a stream passage or other pathway through and under a longitudinally extending embankment 18. The embankment may have a road or path 19 along its upper surface and, for reference purposes, is shown as having a longitudinal embankment axis 20, such as the center stripe of a road or path along the top of the embankment.

Such an embankment normally has an outwardly and downwardly inclined fill slope 22, the upper surface of which defines a desired fill slope plane 23. The fill slope angle 24 of such a plane is measured in a vertical plane 31 perpendicular to the longitudinal embankment axis 20. For convenient reference in FIG. 1, this vertical plane 31 is designated as the vertical plane corresponding to the section line 2—2. The box culvert in this prior art construction extends transversely through the embankment at the same 90 degree angle with respect to embankment axis 20.

Such prior culverts have been constructed with portal assemblies 26, which include one or more symmetrical precast end sections 27, each of which has a U-shaped body portion in which the base portion 28 of the U provides an extension of the bottom wall of the 90 degree box culvert, and in which the upwardly extending arms of the U-shaped body portion provide parallel side walls 29 as straight-line extensions of the side walls 14 and 15 of the 90 degree box culvert.

Such side walls 29 have been provided with downwardly and outwardly sloping upper edges 30 which are inclined at angles equal to the fill slope angle and thus permit such edges to symmetrically match the fill slope plane. The symmetry of such prior precast portal end sections is defined with reference to the described vertical reference plane 31.

Figure 4:
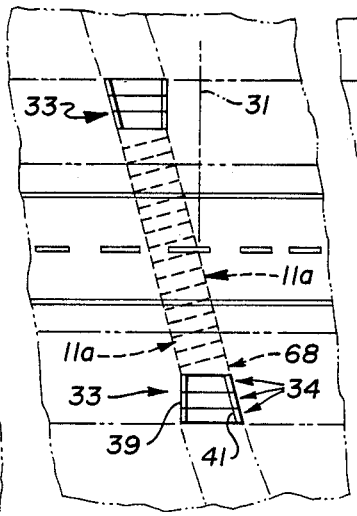
FIG. 4 is a top plan view of a roadway with a skewed culvert running beneath the roadway and with an unsymmetrical portal assembly according to the invention at each end of the conduit.

According to the present invention, portal end sections of various unsymmetrical shapes are provided for use at either end of a box culvert which extends through its longitudinal embankment at a skew angle such as 15 degrees or 30 degrees with respect to the reference plane such as 31, rather than directly across the embankment at the 90 degree angle shown in the prior art constructions of FIGS. 1 to 3. Thus, the portal assembly 33 at the end of the skewed culvert section of FIG. 4 involves one or more portal end sections 34. One configuration for such end sections is shown in FIG. 4 and in the left lower portion of FIG. 5, and the left portions of FIGS. 6 and 7. Another type of unsymmetrical portal end section 35 is shown at the lower right portions of FIGS. 5 through 7.

Each of these unsymmetrical precast portal end sections 34 and 35 includes a U shaped body portion 37 in which the base 38 of the U is adapted to provide a portal bottom wall for the desired stream passage, and in which the arms of the U project upwardly from said base at each side of said bottom wall. These arms provide continuing portal side walls 39 and 41 for such a stream passage, and the portal side walls extend unsymmetrically outwardly from the box culvert end with reference to a vertical plane 31 perpendicular to the longitudinal embankment axis. In the portal end sections 34, one side wall 39 is shown in a plane parallel to the reference plane 31, while the other side wall 41 extends in a vertical plane which provides a straight line extension of one of the side walls of the skewed box culvert. This second side wall thus makes an angle with the reference plane which is equal to the skew angle of the box culvert. The respective side walls 39 and 41 of portal end sections 34 thus provide a flared outlet or inlet arrangement at one or both ends of the skewed box culvert.

Because of the unsymmetrical arrangement of these side walls, their respective downwardly sloping upper edges 42 and 43 are precast with different vertical angles, as measured in the plane of each side wall, in order that both upper edges may fit the desired fill slope plane. The vertical angle for the sloping upper edge 42 of the side wall 39, which lies in a vertical plane perpendicular to the longitudinal embankment axis, will thus exactly match the fill slope angle. On the other hand, the upper edge 43 of the other side wall 41, which lies in a vertical plane extending at an acute flare angle to the longitudinal axis, is precast according to the invention, so that it slopes downwardly and outwardly at a smaller vertical angle than the expected fill slope angle. Thus it will match the fill slope plane through a longer lineal distance than the top 42 of side wall 39.

Figure 6:
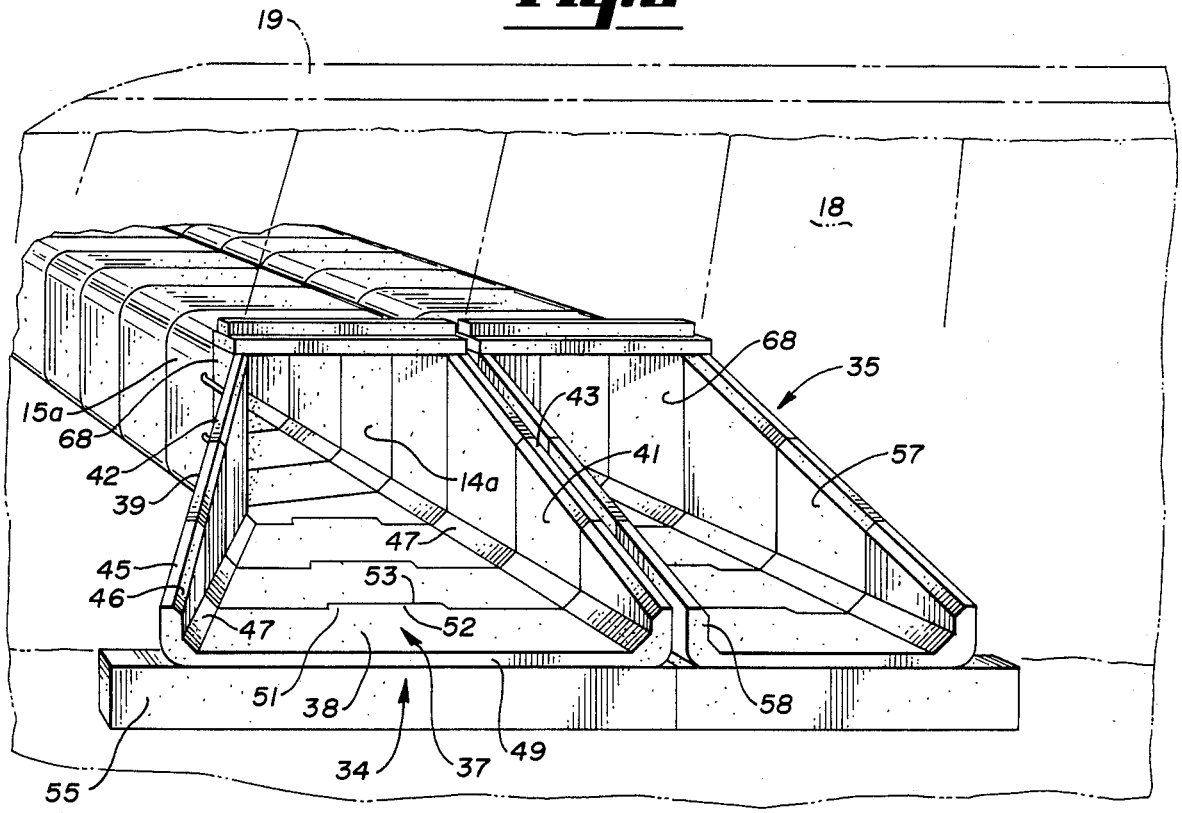
FIG. 6 is an angular perspective view of the double culvert and portal assemblies of FIG. 5 with the earth fill slope plane shown in phantom lines.

As shown particularly in FIG. 6, the downwardly sloping top edges of the portal end section side walls have an outer, upwardly-facing surface 45 which extends straight across in a plane corresponding to the fill slope plane. The inner portions of these upper sidewall edges are beveled inwardly and downwardly to provide inwardly sloping edge portions 46. A reinforcing haunch 47 (FIG. 6) extends along the inner bottom edges of the U shaped base portions to provide the needed strength or reinforcement at the junctions of the base portions with the respective side walls of these U-shaped body portions.

Each portal end section also has inner and outer end faces extending in vertical planes generally parallel to the embankment axis. Thus a vertical outer end face 49 extends along the outer edge of the outermost portal end section at a location and orientation such that it is parallel to the embankment axis and thus projects evenly along the bottom of the fill slope plane. The vertical inner end face of the outermost portal end section will lie in a parallel vertical plane and will have a shape matching the outer vertical end wall surface of the next inner portal end section. The matching end wall faces of these portal end sections are further provided with interfitting connecting means 51, which include an inwardly projecting tongue 52 on the inner face of the outer section and an outwardly facing mating groove or notch 53 in the outer matching end face of the next inner section, as shown in FIGS. 6, 7 and 8.

Similar interfitting connecting means may be provided not only at the base portions, but also along the matching end faces of the vertical side walls of the U-shaped body portions.

To prevent erosion under or around the outer portion of the portal end section, a drop wall 55 may extend vertically down below the bottom of the portal end section. Such a drop wall may be cast in position at the site, or may be separately precast and moved into position at the site, before the separately precast portal end section is placed above it. The drop wall and portal end section may be interconnected by known construction procedures.

Figure 5:
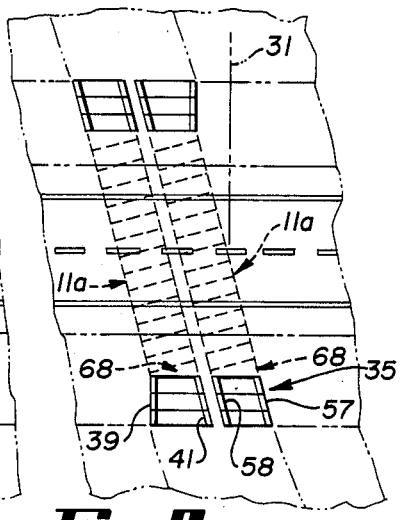
FIG. 5 is a top plan view similar to FIG. 4 showing a double culvert with an alternate unsymmetrical portal end section at two of the portal assemblies.
Figure 7:
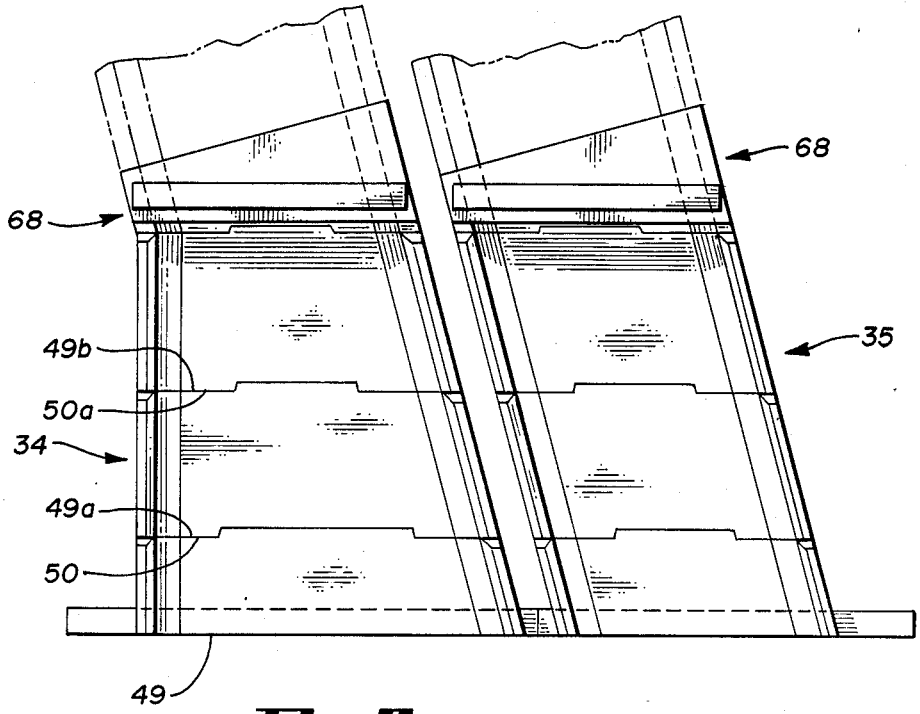
FIG. 7 is an enlarged top plan view of the unsymmetrical transition sections and 3-piece portal end sections of the two portal assemblies of FIG. 6.
Figure 8:
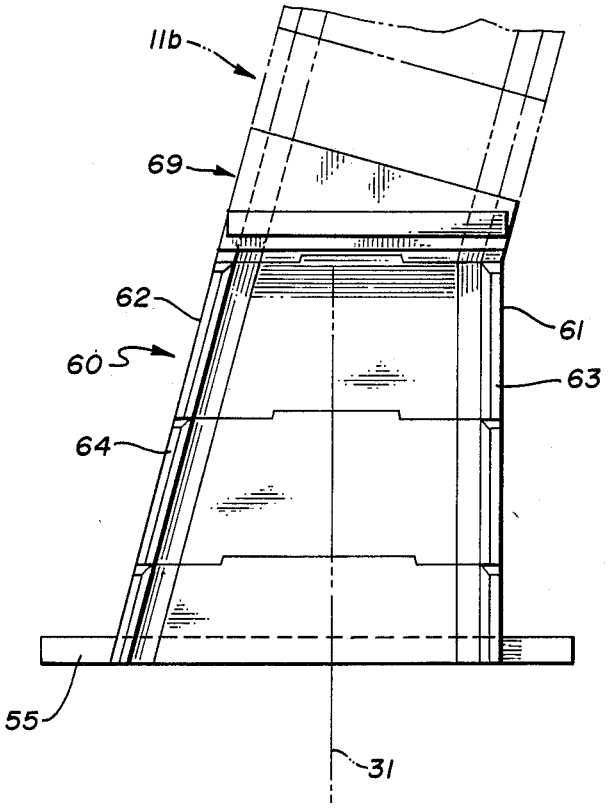
FIG. 8 is a top plan view similar to FIG. 7 showing a portal assembly for an oppositely skewed box culvert end.

As shown in FIGS. 5 through 7, an alternate form of precast unsymmetrical portal end section 35 has a U-shaped body portion in which both side walls 57 and 58 project upwardly in vertical planes which are parallel to each other, but which extend at a common skew angle to the vertical reference plane 31 perpendicular to the longitudinal embankment axis 20. The respective inner and outer vertical end faces of such portal sections 35 are also parallel to each other and parallel to the longitudinal axis 20. To fit the common fill slope plane, the upper edges of the parallel side walls 57 and 58 slope downwardly and outwardly at an angle which is smaller than the fill slope angle, just as in the case of the similarly oriented upper edges 43 of the side wall 41 of the portal end section 33 already described.

The arrangement shown in FIGS. 5 through 7 is particularly useful where a skewed box culvert is needed, and where the possible volume or flow rate of the stream passage involved needs the cross sectional stream passage area of a double line of box culverts 11*a* at the same skew angle shown for the single box culvert 11*a* in the embodiment of FIG. 4. Portal end sections 35 can also be used where a skewed single line box culvert needs no flare at the portal ends.

FIG. 8 shows another alternate portal end section construction for use in connection with a box culvert 11*b* which is oriented at an opposite skew angle, with respect to reference plane 31, as compared to box culverts 11*a* already described. Portal end section 60 includes one or more U-shaped body portions, which provide respective portal side walls 61 and 62 extending unsymmetrically (with reference to the vertical plane 31 perpendicular to the longitudinal embankment axis). In this case side wall 61 is positioned in a vertical plane generally parallel to the reference plane, while side wall 62 flares outwardly with respect to side wall 61 at an acute angle to such a reference plane corresponding to the skew angle of culvert 11*b*.

To make sure that the upper edges of the side walls of such an unsymmetrical portal end section fit the common fill slope plane, the downwardly and outwardly sloping top edge 63 of side wall 61 will slope at an angle exactly equal to the fill slope angle, while the top edge 64 of outwardly flaring side wall 62 will be made with a slope angle smaller than the fill slope angle and with an upper edge length which is greater than that of the upper edge 63.

Figure 9:
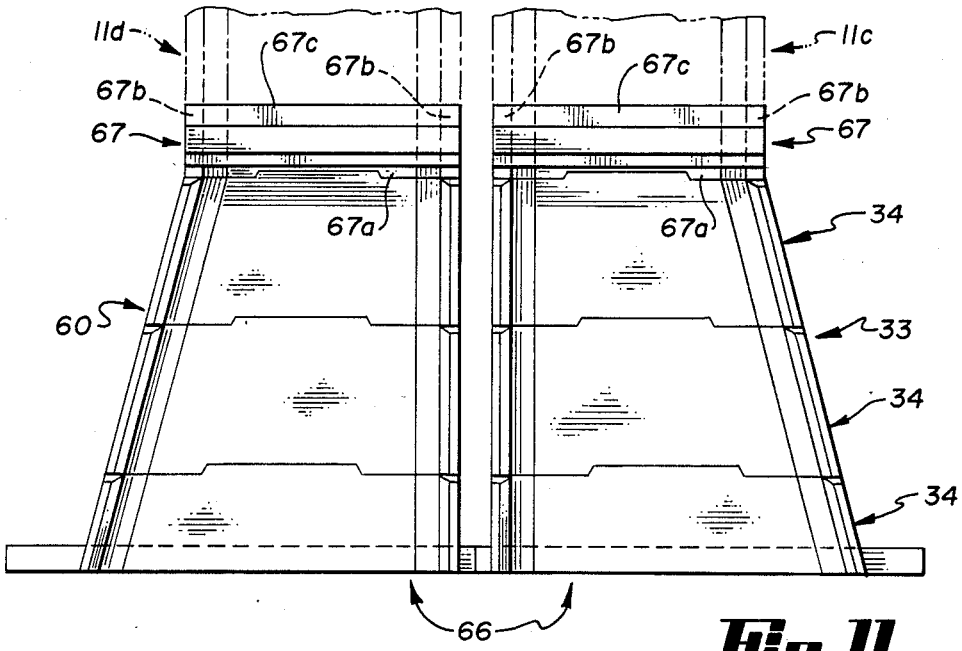
FIG. 9 is a top plan view of a double line unskewed box culvert with oppositely unsymmetrical portal end sections and unskewed transition sections in the portal assemblies.

FIG. 9 shows an alternate portal assembly 66 for effective use at the outer ends of parallel box culverts 11*c* and 11*d* which extend perpendicularly across and through the embankment to provide a pair of 90 degree stream passages with an individually unsymmetrical precast portal assembly at the outer end of one such box culvert and with a second and oppositely unsymmetrical portal end section at the corresponding outer end of the adjacent box culvert passage. For this purpose, precast portal end sections 34 are connected at one end of the box culvert 11*c*, while an oppositely unsymmetrical assembly of portal end sections 60, as described in connection with FIG. 8, can be connected to the adjacent outer end of the other parallel box culvert 11*d*.

Portal assemblies 33 and 60 in FIG. 9 may have their respective unsymmetrical inner end sections connected directly to the corresponding outer ends of the 90 degree box culverts 11*c* and 11*d*. As shown, however, symmetrical transition sections 67 may be connected between the inner portal end sections and the outer end sections of the box culverts. Such sections 67 include a U-shaped body portion having a bottom wall 67*a*, parallel upwardly-extending side walls 67*b*, with an interconnecting lintel beam 67*c* supported on the upper edges of walls 67*b*.

For optimum use of the unsymmetrical precast portal end sections at one end of a skewed box culvert as in FIGS. 4 through 7, the invention further provides an unsymmetrical precast portal transition section. Such section is shown at 68 in FIGS. 4 through 7 for interfitting and matching engagement between an outer end face of the box culvert body portion and the innermost face of the unsymmetrical portal end sections. A corresponding but oppositely angular transition section 69 is shown in FIG. 8.

Figure 10:
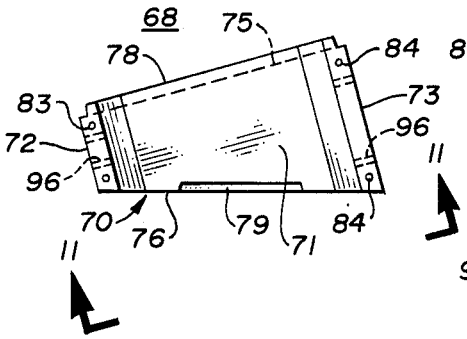
FIG. 10 is a top plan view of the U-shaped body portion of an unsymmetrical angular transition section as used in the portal assemblies of FIGS. 4 to 7.
Figure 11:
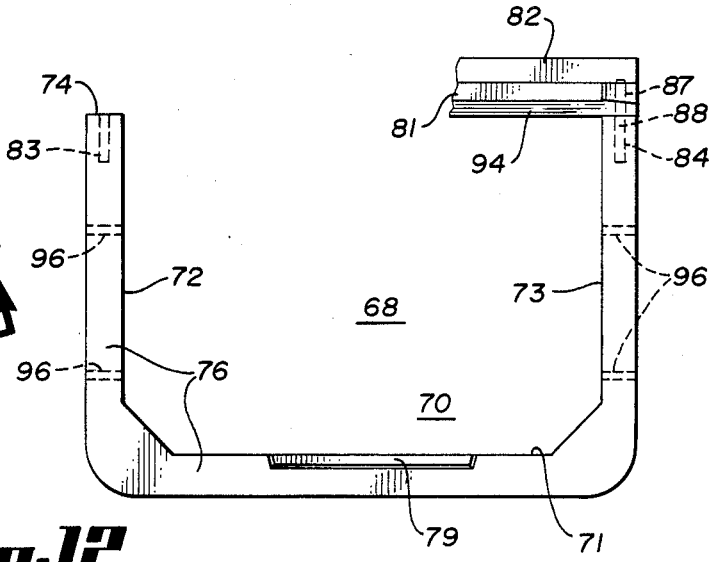
FIG. 11 is an elevation in enlarged scale taken along line 11—11 of FIG. 10.

Further details of unsymmetrical transition section 68 are shown in FIGS. 10 and 11. Each such transition section has a U-shaped body portion 70 in which the base of the U provides a wedge shaped bottom wall 71 for the desired stream passage. The upwardly projecting arms of the U provide first and second transition side walls 72 and 73 which are preferably parallel to each other as extensions of the side walls 15*a* and 14*a* (see FIG. 6) of the skewed box culvert body 11*a*, and which are of respectively different horizontal lengths for the stream passage between said culvert end side walls and the side walls at the inner vertical end face of the nearest portal end section.

The upper edge surfaces 74 of these side walls extend horizontally at the level of the inner top wall of the box culvert passage to extend such passage to the portal end section, where the side wall upper edges of the end sections are then sloped downwardly to fit the fill slope plane. Each transition section has a vertical inner end face 75 which extends in a vertical plane perpendicular to the parallel side walls. The opposite outer end face 76 of the transition section has its surface in a vertical plane parallel to the expected embankment axis 20 and thus parallel also to the inner vertical end face of the adjacent portal end section.

As shown in FIG. 10, the inner end face of the transition section has a projecting tongue 78 for interfitting engagement with a corresponding groove or recess in the adjacent end wall of the outer box culvert section. The outer end face 76 of the transition section is provided with a suitable groove or recess 79 for interfitting engagement with a corresponding projection on the inner end face of the adjacent portal end section. It will be understood that the projecting tongue 78 on inner transition section end wall 75 can be replaced by a suitable groove or recess (not shown), when such transition section is to be placed at the particular end of a box culvert which might require such a recess, rather than a projecting tongue.

To close the open top of the transition section, a separate lintel beam 81 (FIGS. 11 to 15), having a wedge shape corresponding to that of the transition section bottom wall 71 is supported on the horizontal upper edges 74 of the transition section side walls. The lintel beam may carry an upwardly projecting curb 82 which serves as a fill-retaining lip to prevent material from falling out of the fill slope section and into the completed portal assembly.

Such a separately precast lintel member 81 thus provides a top transition wall for the stream passage from the vertical outer end face of the skewed box culvert (i.e. from the matching vertical inner end face of the transition section) to or just short of the outer vertical end face of the transition section, which is generally parallel to the expected longitudinal embankment axis. The upwardly-projecting curb or cross-beam 82 may extend across the upper surface of the lintel member relatively close to the outer end face plane of the lintel member.

Figure 12:
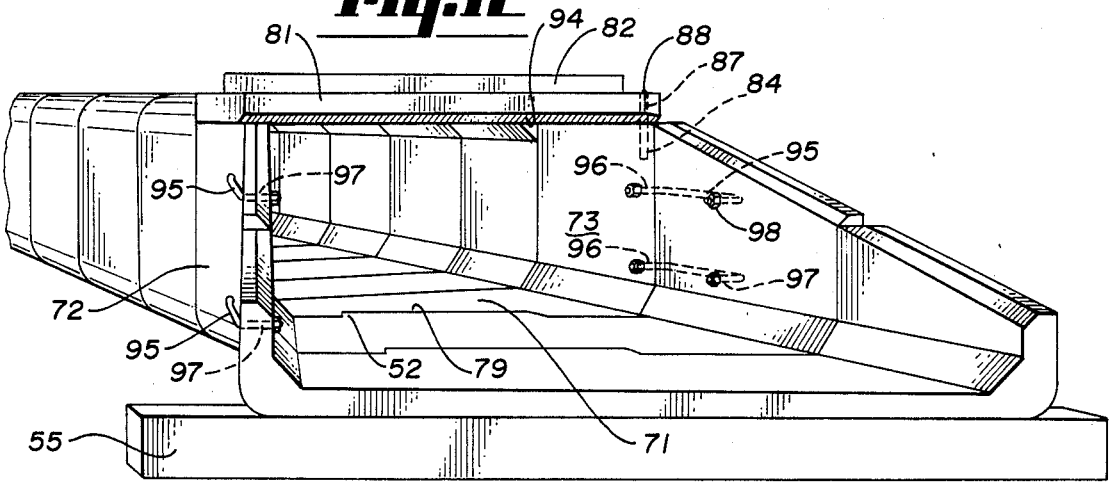
FIG. 12 is a perspective view of a skewed culvert end with an angular transition section and lintel member, and with a flared unsymmetrical two-piece portal end section.

Interlocking means are provided, as shown in FIGS. 10, 11 and 12, to hold the lintel member 81 in properly-aligned position on top of the horizontal edges 74 of the transition section side walls. For this purpose, upwardly-open vertical sockets 83 are provided in the upper edges of side wall 72, and similar upwardly-open sockets 84 are provided in the upper edge of side wall 73.

Figure 13:
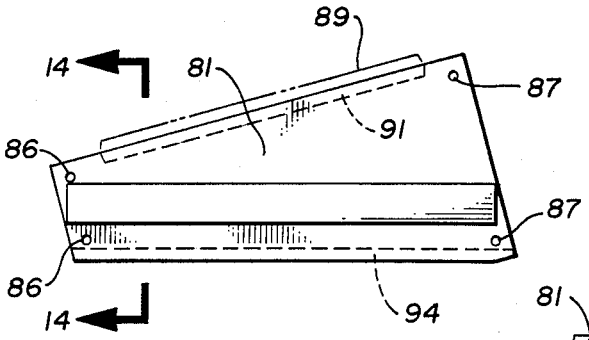
FIG. 13 is a top plan view of the lintel member of FIG. 12.
Figure 14:
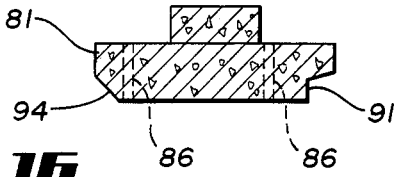
FIG. 14 is an enlarged sectional view taken along line 14—14 of FIG. 13 having a groove formed therein for interfitting engagement at one end of a box culvert.
Figure 15:
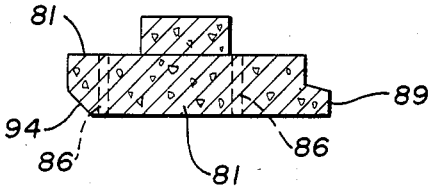
FIG. 15 is a view similar to FIG. 14 but with a tongue formed on the lintel member instead of a groove, for interfitting engagement at an opposite culvert end.

Corresponding vertical openings are provided in the lintel beam 81, as shown particularly in FIG. 13, where openings 86 are positioned for ultimate vertical registration with sockets 83 of the shorter side wall 72, while similar vertical openings 87 at the other side of the lintel beam 81 are positioned for vertical registration with the corresponding sockets 84 of the longer side wall 73. After the precast transition section has been positioned at the desired end of the box culvert and in proper alignment therewith, the lintel member can be positioned above it, with the vertical holes in appropriate registration on top of both side walls of the transition section. Locking pins 88 may then be inserted vertically downwardly through the lintel member openings into the corresponding sockets, and the upper ends of such openings can then be filled with an appropriate sealing substance to maintain these interlocking means and the respective transition section and lintel member in the desired registration with each other. Thus the inner end face of the lintel member will extend in the same vertical plane as the inner end face of the transition section.

Interfitting means are also provided to insure proper matching of the inner end faces of both the lintel member and transition section with the corresponding outer end wall surfaces of the culvert end. Thus the tongue 78 (FIG. 10) may project from the inner end face of the transition section all the way around its bottom and side walls, while a similar tongue 89 on the lintel member (FIGS. 13 and 15) completes the provision of projections for interfitting engagement with recesses in the outer faces of all four culvert end walls. If the transition section and lintel beam are to be connected at the opposite end of such culvert, where the culvert end itself has projecting tongues, then the transition section and lintel beam can be precast with appropriate recesses, such as recess 91 in the lintel member of FIG. 14, in their inner end wall faces for interfitting engagement with such culvert end face tongues.

The outer end face of the transition section and the inner end face of the adjacent portal end section also have complementary interfitting means to insure matching engagement of the inner end faces of the bottom and side walls of the portal end section with the corresponding bottom and side walls at the outer end face of the transition section. Thus the recess 79 (FIG. 10) on the outer end wall face of the transition section bottom wall, is adapted to receive the described inwardly-projecting tongue 52 of the adjacent inner portal end section. Additional complementary interfitting means may be provided between the mating end faces of the corresponding side walls.

Since the portal end sections are open at the top, there is no need for such complementary interfitting means on the outer end wall surface of the lintel member. As shown at 94 in FIGS. 11 to 15, however, the lower outer edge of the outer face of the lintel member is beveled at 94.

Holding means are also provided to secure the transition section in matching engagement with an adjacent portal end section as part of a complete portal assembly at an outer end of a skewed box culvert. One such holding means includes a plurality of bar members 95, which have a length adequate to bridge the joint between the matching end wall faces of the sections involved. Such bars 95 have inwardly-projecting threaded ends designed for insertion of one end through a retaining hole 96 in a transition section side wall and a corresponding hole 97 in a portal end section side wall (and similarly in a side wall of the box culvert end). The angular ends of the holding bars 95 are secured in such openings 96 and 97 in desired manner, for example by nuts 98 on the threaded ends which project inwardly through the section side walls. Such bars may be inserted from either the inside or outside walls of the connected sections. Other types of holding means may be used as desired.

The number of portal end sections to be assembled with a given transition section as part of a complete portal assembly will depend partly on the relative size of the box culvert itself, partly on the length of the portal side walls required to match the particular fill slope plane, and partly on the capacity of the handling equipment which will already be available at the site for lifting and installing the individual sections of a multi-section box culvert.

As shown in the drawings, the portal end assembly sections have roughly similar dimensions between their inner and outer faces comparable to the corresponding distances from an inner face to an outer face of one of the box culvert sections. In the examples of FIGS. 4 through 8, the complete portal assemblies each include one transition section and three portal end sections. In the example shown in FIG. 12, the complete portal assembly includes one transition section and only two portal end sections. In a case where the upper box culvert wall is not too high above the bottom culvert wall, and particularly if an unusually steep fill slope angle is to be used, a single portal end section might be adequate.

Figure 16:
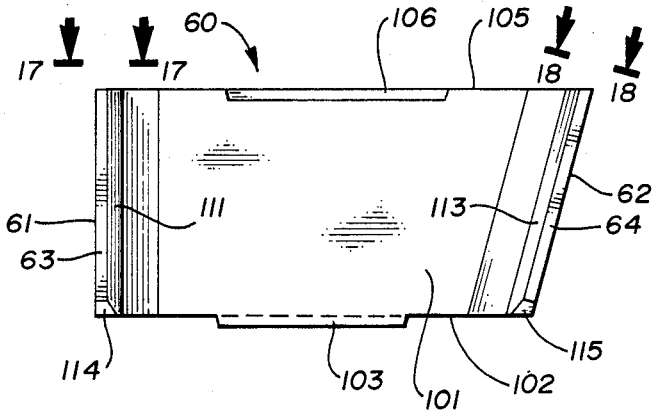
FIG. 16 shows another top plan view of the U-shaped body portion of the unsymmetrical portal end section of FIG. 8.

FIG. 16 shows another top plan view and further details of portal end section 60 of FIG. 8, oriented in the position in which it could be used at the opposite end (upper end in the drawing) of the box culvert of FIG. 8. The open-topped, U-shaped body portion of this unsymmetrical end section includes a bottom wall 101 with an inner vertical end face 102 on which a tongue 103 is provided for engagement with a recess (similar to 79 in FIG. 10) on the adjacent transition section, or a similar recess on an adjacent inner portal end section. The outer vertical end wall face 105 of the U-shaped body portion has a corresponding recess 106 for engagement with a similar tongue on an adjacent outer portal end section. Although the respective locations of the tongues and recesses could theoretically be reversed, it is preferable, for more convenient and effective installation, to provide the tongues, as shown, on the inner faces of each portal end section and to provide the recesses in the outer faces of each portal end section and transition section involved.

One side wall 61 of the body portion of end section 60 extends in a vertical plane which is perpendicular to or only slightly flared or skewed from the reference plane perpendicular to the longitudinal embankment axis. The other side wall 62 extends in a vertical plane at a substantially greater outward flare or skew angle.

Thus the downwardly and outwardly-sloping upper surface 63 of side wall 61 will slope at a sharper vertical angle, i.e. closer to the exact fill slope angle, while the corresponding sloping surface 64 at the top of side wall portion 62 will extend outwardly at a more gentle angle and over a longer distance from the inner end face 102 to the outer end face 105, as compared to top surface 63. The respective top edges 63 and 64 of this portal end section have respective inner beveled surfaces 111 and 113 to help provide smoother hydraulic flow characteristics. The upper corner edges where the sloping side wall edges 63 and 64 would intersect the inner end wall surface 102 of the innermost portal end section are precast with small horizontal flat surfaces 114 and 115 to help avoid chipping.

Figure 19:
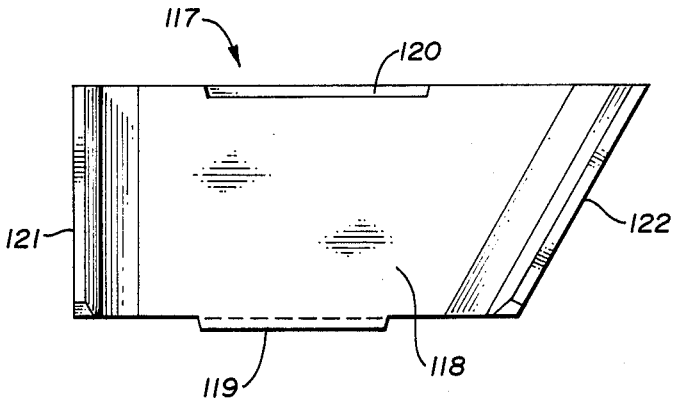
FIG. 19 is a top plan view similar to FIG. 16 but with the flared side wall at a greater angle than that shown in FIG. 16.
Figure 18:
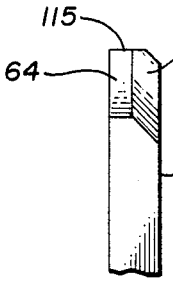
FIGS. 17 and 18 are detail elevations taken at lines 17—17 and 18—18 respectively of FIG. 16.
Figure 17:
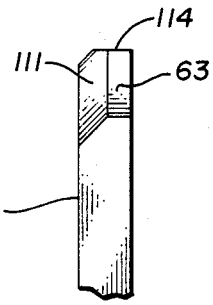

Another portal end section 117 (FIG. 19), of the same general type as section 60 in FIG. 16, has a bottom wall portion 118 which is somewhat wider at the inner end and substantially wider at the outer end, as compared to the bottom wall 101 of portal end section 60. In this case the bottom wall again includes a projecting tongue 119 at the inner vertical end face of the section, and a recess 120 at the outer vertical end face of the section. One side wall 121 extends outwardly in a vertical plane generally similar to that of side wall 61 in FIG. 16, i.e. in a plane parallel to or at only a slight diverging angle from the vertical reference plane perpendicular to the longitudinal embankment axis. The other side wall 122 diverges outwardly from the inner face to the outer face of the end section at a substantially greater skew or flare angle, as compared to side wall 62 in FIG. 16. Thus the invention accommodates a number of different possible flare angles and skew angles for use at the ends of box culverts which are oriented at skew angles of as much as 30 degrees or more with reference to the longitudinal embankment axis.

FIGS. 20 to 30 show a molding form according to the present invention which can be used for selectively precasting either or both of the desired concrete portal end sections and transition sections for a complete portal assembly. The form 127 includes an inner form member 128 which has upwardly-facing top mold surfaces 129, 131, 132 and 133. Surface 133 is provided by a selectively insertable and removable wedge-shaped insert for use to provide a desired skew or flare angle between the side edge portions 129 and 131 of this mold surface. The mold surface area 132 is provided by a selectively insertable and removable longitudinally-rectangular section which may be used to increase the width of the angular inner form, as shown, or may be connected selectively directly between the outer edge portions 129 and 131, without any intermediate wedge-shaped section 133, to provide parallel side edges on the top surface of the inner mold member at selectively different transverse spacings, for assembly at box culvert ends of correspondingly different widths.

Figure 21:
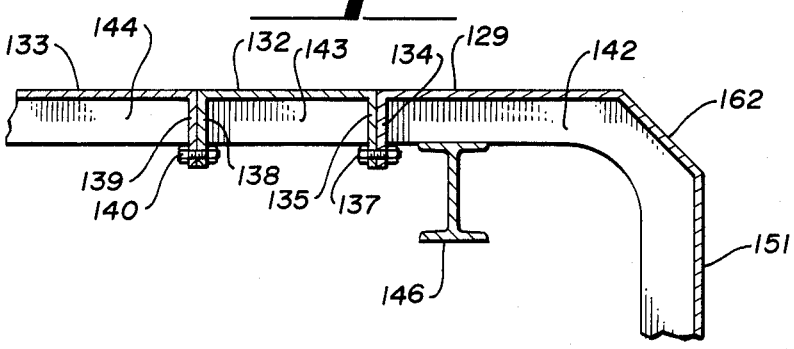
FIG. 21 is a partial sectional view on the line 21—21 of FIG. 20.

As shown in FIG. 21, the upwardly-facing top mold wall sections have connecting means along their respective edges to facilitate the selective connection of the different elements to each other for a desired top wall shape. Thus a downwardly-projecting flange 134 along the inner edge of top wall portion 129 can be rigidly secured to a corresponding edge flange 135 on rectangular insert member 132, by means of bolts 137.

Similarly, an opposite edge flange 138 along the rectangular insert 132 can be secured to a matching flange 139 on the wedge-shaped insert 133 by bolts 140, while similar matching flanges and bolts at the meeting edges 141 of longitudinal mold surfaces 131 and 133 can secure the complete assembly of all these parts when needed or desired.

The top mold wall surfaces are reinforced and supported by vertical cross flanges 142, 143 and 144 on the respective sections 129, 132 (if used) and 133 (if used). It will be understood that inner flanges 134 at the inner edge of mold wall 129 can be selectively connected directly to corresponding inner edge flanges on section 131, when an upper mold wall surface area of minimum width and with parallel outer edges is desired for a particular application.

Figure 20:
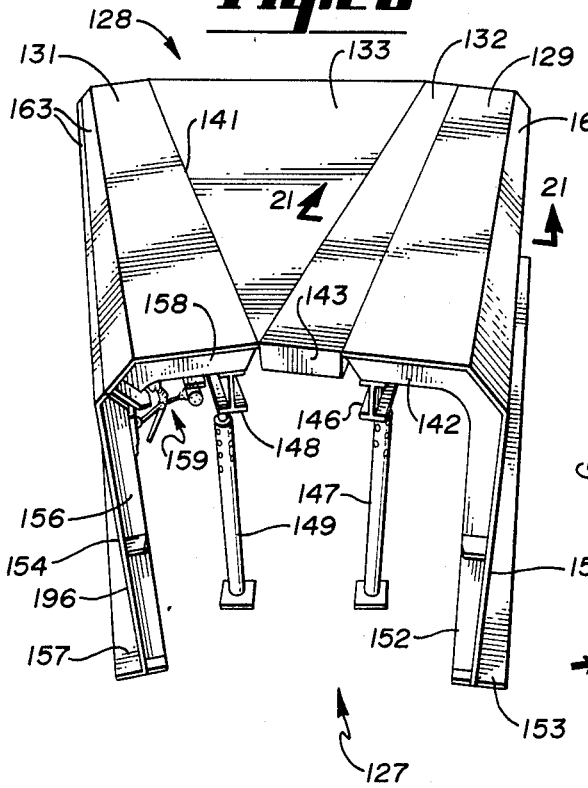
FIG. 20 is a perspective view of one selective shape for an inner molding form for precasting portal end sections with flared side walls.

To help support the upwardly-facing top mold wall elements, a longitudinal I-beam support 146 extends longitudinally under the edge portion 129 in FIG. 20. Such I-beam support is held at the desired vertical distance above the ground support, for example at a particular manufacturing plant location, by vertically adjustable supporting posts or jacks 147. A similar I-beam support 148 extends longitudinally under the opposite outer edge portion 131 and is supported at the desired height by similar vertically-adjustable supporting jacks 149.

The inner form member 128 also has outwardly-facing side mold walls 151 and 154. Side wall 151 is secured to vertical legs 152 which extend down from the reinforcing and support flanges 142 of upper mold wall 129. The lower ends of such supporting legs 152, and the lower edge of the side mold wall 151, are supported on the ground or a suitable base plate 153. Thus the vertical position of the side mold wall 151 is determined by its support on such a base plate, while the I-beam 146 and vertical jack 147 provide necessary support directly under the top wall section 129, as shown.

Similarly, the outwardly-facing opposite side mold wall 154, reinforced by vertical legs 156, is supported on a similar base member 157. At this edge of the inner form member, however, the vertical reinforcing legs 156 are not permanently fixed as integral downward extensions of the reinforcing cross flanges 158 for the top edge section 131. Flanges 156 and 158, however, can be selectively held in molding position in essentially common vertical planes (similar to the common planes of reinforcing flanges 142 and vertical legs 152 of top section 129), by releasable connecting mechanisms 159 shown generally in FIG. 20 and in more detail in subsequent figures. Mechanisms 159 hold the inner form portions 131 and 154 in the desired rigid orientation with respect to each other during the molding process, but can be operated to provide a desired relative collapsing movement of these parts to facilitate removal of a precast section after its casting process is complete.

The inner form member further includes outwardly and downwardly-sloping or beveled mold edges at 162 and 163 to provide a reinforcing haunch along the respective inner longitudinal edges of the desired U-shaped body portion of whatever portal assembly section is to be cast on this form. This inner form member thus provides respective upwardly-facing and oppositely outwardly-facing top and side wall mold surfaces which correspond respectively to upside-down images of the inner bottom wall and opposite inner side wall surfaces of at least one desired U-shaped body portion, so that such a portion may be precast as a monolithic unit in upside-down position above the top mold wall surface and down along the opposite side mold wall surfaces of this inner form member.

Figure 22:
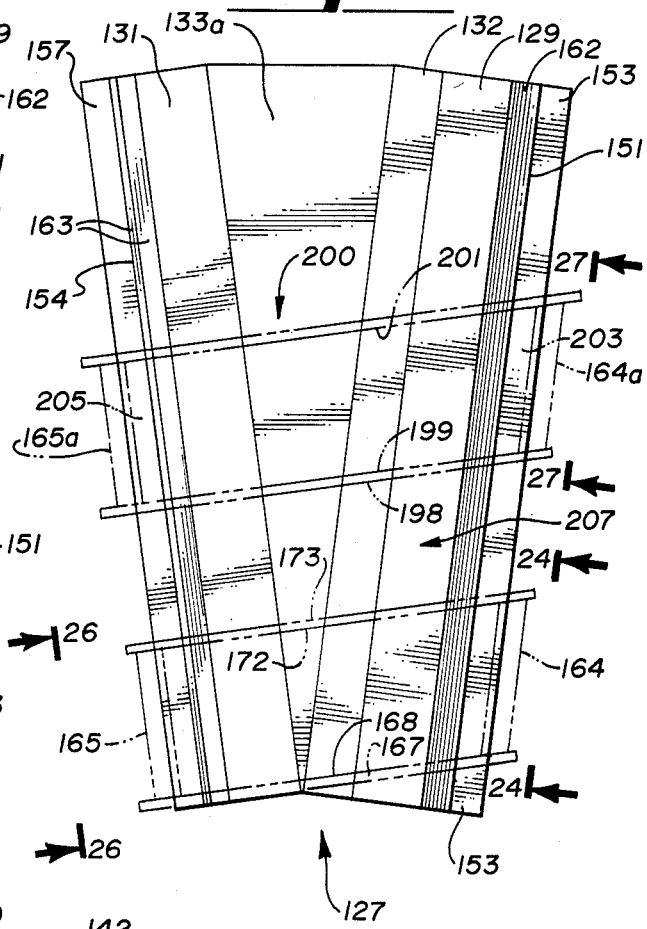
FIG. 22 is a top plan view of the apparatus of FIG. 21 with a modified top shape, and with outer side wall, bottom and end wall form members shown schematically for casting two (1st and 3rd) U-shaped body portions for a 3-piece unsymmetrical portal end section.
Figure 23:
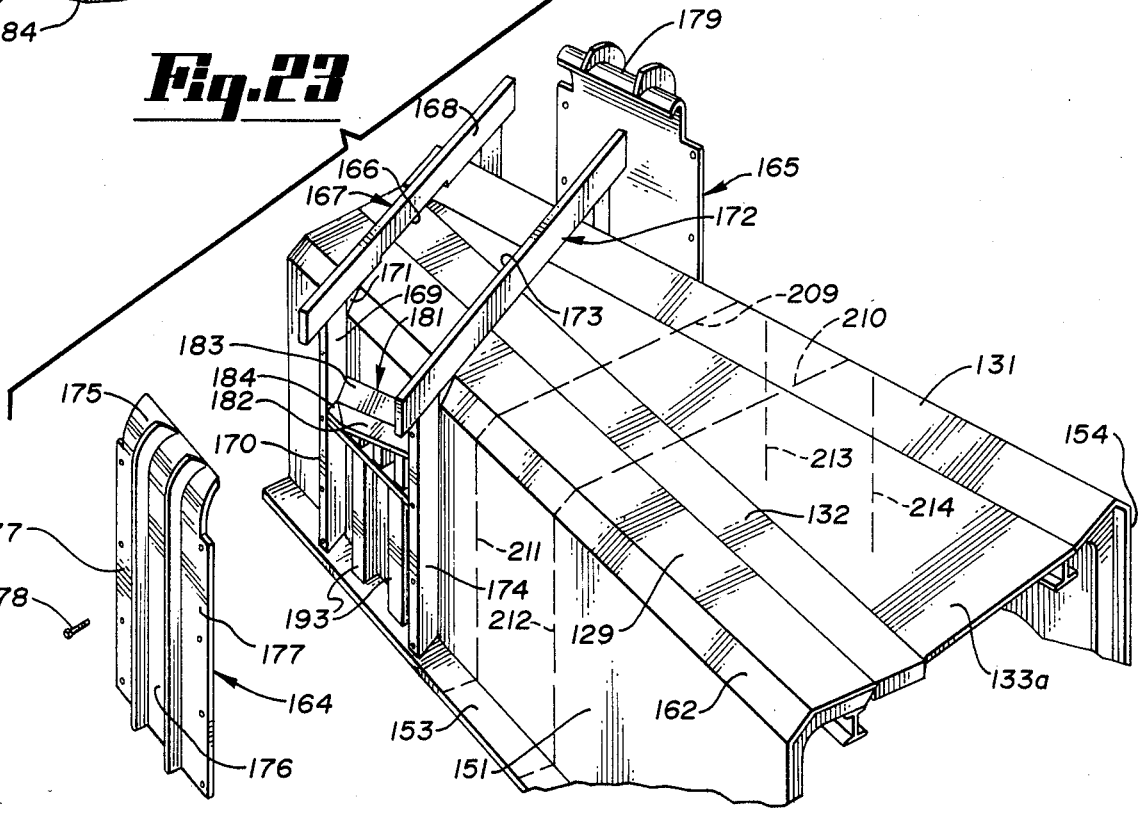
FIG. 23 is an exploded perspective view toward the narrow end of the molding apparatus of FIG. 22 as set up for casting the inner U-shaped body portion for a 3-piece flared portal end section.

FIGS. 22 and 23 show further details of the complete molding form, as used to precast unsymmetrical portal end sections 34 of the type shown in FIG. 4, for installation with a suitable transition section at one end of a skewed box culvert. The inner form member shown in these figures is identical to that shown in FIG. 20, except that the wedge-shaped section 133*a* is shown with a smaller diverging flare angle, such as 15 degrees, as compared to the greater flare angle, such as 30 degrees, in the wedge-shaped section 133 in FIG. 20. The complete molding form includes at least two outer side wall form members 164 and 165 supported in respective positions extending along and spaced outwardly from the opposite outwardly-facing mold wall surfaces 151 and 154 of the inner form memoer. These outer side wall form members have respective inwardly-facing side wall mold surfaces which correspond to upside-down images of the outer side wall surfaces of the desired U-shaped body portion which is to be precast on this form.

The molding form also includes at least two end wall form members for selective assembly across the upwardly-facing top mold wall surface and vertically down across the space between the outwardly-facing side wall surfaces of the inner form member and the inwardly-facing side mold wall surfaces of the outer side wall form members. These end form members 167 and 172 have respective inner and outer end wall mold surfaces facing each other and corresponding to upside-down images of the opposite inner and outer end faces of the desired U-shaped body portion to be precast on this form.

Thus the first or inner end wall form member 167 includes an upper cross member portion 168 which extends at a desired angle across and in contact with the upwardly-facing top mold wall of the inner form. As shown in FIGS. 22 and 23, this first end wall member provides an inner end face molding surface in a vertical plane which is essentially perpendicular to side mold wall 154 of the inner mold form and which extends at an angle with respect to inner form side wall mold surface 151, as determined by the desired angular flare of the portal end section side walls, and the selection of a correspondingly wedge-shaped inner mold surface 133*a*. The vertical downwardly-extending leg portion 169 of end wall form 167 may be formed as a separate member and rigidly secured to the cross member 168 in the same plane as the top wall surface of the inner form member. This vertical portion 169 has a vertical outer edge 170 to which the outer side wall form member 164 can be secured. It also includes an inwardly-projecting angular section 171 at its upper end which fills the angular space adjacent the inclined inner mold wall portion 162 which provides an upside-down image of the haunch surface at the longitudinal inner edge of the desired U-shaped body portion to be cast on this form.

A second or outer end wall form member 172 has its upper cross member 173 extending across and similarly supported by the upper surface of the inner form member to provide an outer end face molding surface in a vertical plane essentially parallel to and spaced outwardly from the first end wall form member, as shown. The vertical leg portion 174 of the second end wall form member similarly extends downwardly in a vertical plane parallel to and spaced from the leg portion 169 of the first end wall form member. This second end wall form member accordingly provides a molding surface facing oppositely toward the molding surface of the first end wall form member 167 and corresponds to an upside-down image of the outer vertical end face of the desired U-shaped body portion to be precast on this form.

As shown in FIG. 23, the outer side form 164 has a top inwardly-curved portion 175 which has a shorter length longitudinally of the form than the lower body portion 176 of the outer side form member. Thus the upper curved side wall mold edge 175 is adapted to fit between the upper transverse portions 168 and 173 of the first and second end wall form members, while the lower portion of side wall form 164 has edge extensions 177 which overlap the outer edges (such as 170) of the vertical legs 169 and 174 and may be secured in position thereon by bolts 178.

The curved upper end 175 of the outer side wall form member is shown as an upper part of the outer side wall mold member 164 and is subject to the dimensional requirement that portion 175 must fit between the end wall form members, while the main body portion must project longitudinally farther, so as to overlap and be secured to the vertical portions of such end wall sections.

Figure 24:
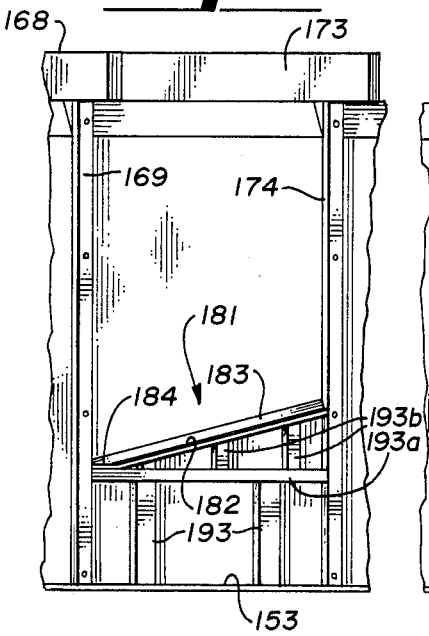
FIG. 24 is a side elevational view taken along line 24—24 of FIG. 22, with the outer side wall form omitted.
Figure 26:
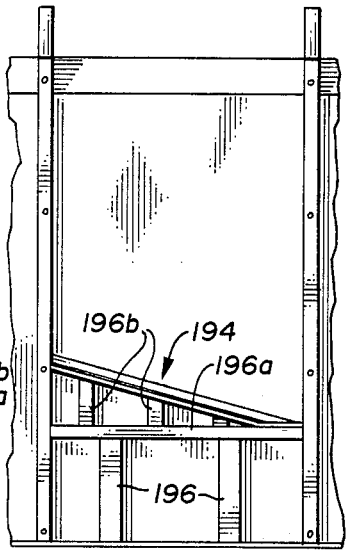
FIG. 26 is a side elevational view taken along line 26—26 of FIG. 22 with the opposite outer side wall form omitted.
Figure 27:
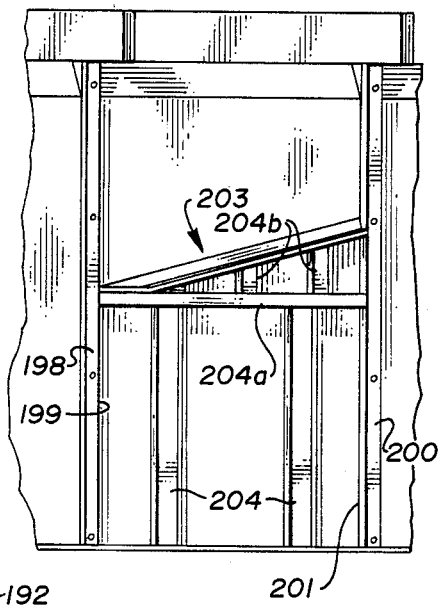
FIG. 27 is a side elevational view similar to FIG. 24 taken along line 27—27 of FIG. 22, and showing the position and slope of a bottom form member for the third U-shaped body portion of the 3-piece flared portal end section to be precast in such form.
Figure 25:
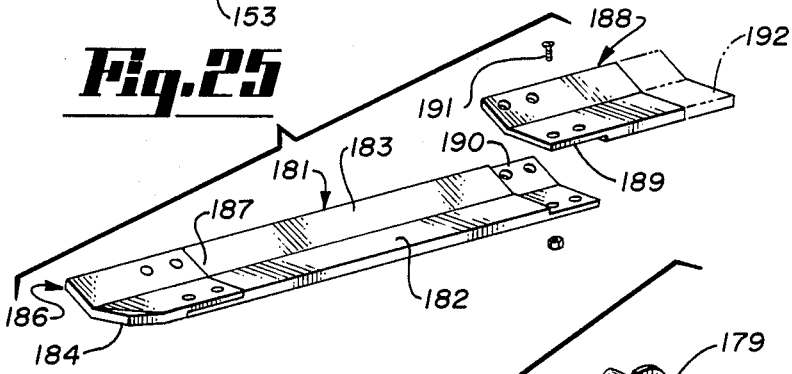
FIG. 25 is an enlarged perspective view showing details of a bottom form member as used in FIG. 24.

To close the bottom of the mold space between the inner form member and the outer side wall form members, first and second bottom form members 181 and 194 are supported so that they extend along the respective opposite sides 151 and 154 of the inner mold form. Details of construction of bottom form 181 are shown in FIGS. 23, 24 and 25. Member 181 has upwardly-facing top wall mold surfaces which correspond to an upside-down image of the upper edge surface of the desired U-shaped body portion side walls. Such a molding surface is shown at 182, 183, where surface 182 is designed to provide a downwardly and outwardly-sloping flat upper edge for a portal end section, in which such upper edge is adapted to fit the fill slope plane at which such a portal section is to be used. Surface 183 extends longitudinally in a plane which is inclined upwardly and inwardly toward the facing side wall of the inner form member to provide for a downwardly and inwardly-sloping beveled edge at the top of the portal section side wall as already described.

Thus the bottom form member 181 extends longitudinally of the inner mold form at a vertical distance below the upwardly-facing top wall mold surface and at a vertical angle, corresponding to the upside-down image of the desired vertical heights and slopes of the respective U-shaped body portion side wall upper edges above the inner bottom wall surface of the desired U-shaped body portion.

Bottom form members 181 and 194 preferably include means for selective adjustment of at least one or more of their respective characteristics as to length, vertical angle, and horizontal angle of the end wall form members, in order to provide bottom form members which correspond to selectively different upside-down images of the upper side wall edges of respectively different U-shaped body portions. As shown in FIG. 25, the lower end of bottom form member 181 is provided with a selectively replaceable extension 186 having a small horizontal molding surface 184 adapted to provide a slightly-flattened upper edge for the sloping side wall of an inner portal end section to be cast on this mold. Surface 184 avoids the casting of a sharp angular point at the top of the sloping portal side wall, which might be subject to breaking or chipping. For different vertical angles of bottom form member 181 along the sides of the inner mold form, different relative angles of the flat portion 184 with respect to the upper edge molding surface 182 are desirable. To obtain such differences, any one of a plurality of different end extensions 186, with various different relative angular positions for flat area 184, may be selectively and removably attached at the lower end of sloping bottom form member 181, as shown at separation line 187. Such removable attachment may be made by counter-sunk bolts, as described below for different upper end extensions.

Similarly, the upper opposite end of bottom form member 181 is provided at 190 with means for selective attachment of any one of a number of different end extensions of different length. Such an extension 188 (FIG. 25) has an inner end portion 189 to interfit with portion 190 at the upper end of bottom form member 181. A longer extension, as shown by the dotted outline at 192, could be selectively attached as an alternative, when a longer bottom form member 181 is needed. In this case, counter-sunk bolts 191 can project through corresponding holes in the end portions 189 and 190 and be removably secured in position by suitable nuts at the lower ends of such bolts.

Other equivalent means may be provided for selective removable connection of any one of a plurality of such extension pieces as 186, 188 and 192, so that the main intermediate longitudinal portions of these bottom form members can be suitably modified at either or both ends for a particular application.

The body portion of bottom form member 181 can be supported at its desired vertical height by vertical supporting beams 193, which can have different vertical heights to support a horizontal intermediate base 193*a* at the desired vertical level. Base 193*a* is rigidly connected by posts 193*b* to the form member body portion 181, so that parts 193*a*, 193*b* and 181 can be preassembled as a unit and then placed at the desired height and slope by selected posts 193. The possibility of selective positioning of form 181 at different heights is illustrated by the higher level in FIG. 23 as compared to the lower level used in FIG. 24.

The second bottom form member 194 at the opposite side of the inner mold form can be similarly supported at its intermediate portions by vertical support beams 196, on which the subassembly of intermediate base 196*a*, connecting posts 196*b* and form 194 can rest.

In the arrangement shown in FIGS. 23 to 26, the bottom form member 194 is slightly steeper and shorter than the bottom form member 181, and thus makes it possible to cast in upside-down position a U-shaped body portion in which the side walls extend in vertical planes at a variety of different selected angles and slopes, depending on the selected angle of the wedge-shaped portion 133 or 133*a* of the top wall of the inner mold, and depending on the desired angular orientation of the end wall forms 167 and 172 across the inner mold form. As shown, to form inner portal end sections of the type shown at 34 in FIGS. 4 to 7, end wall forms 167 and 172 define vertical end face planes which are perpendicular to the vertical side wall mold surface 154 of the inner form member and which intersect the vertical opposite side wall 151 of the inner form member at an acute angle, and thus intercept an axially-longer space along angular side wall 151 than the space intercepted by said end wall members along the mold side wall 154.

As shown in FIG. 22, another pair of end wall form members may be positioned across the inner form member to provide for the casting of a further upside-down U-shaped body portion of an outer portal end section 34. Thus a third end wall form member 198 has a vertical end face molding surface 199 facing outwardly along the form in such a position that the surface 199 and the inwardly-facing end face molding surface of the second end wall form 172 will be spaced longitudinally apart the exact distance needed to accommodate the subsequent casting of a second or intermediate portal end section intended for ultimate assembly between the respective inner and outer portal end sections to be case between the first and second end wall form members, on the one hand, and the third and fourth end wall form members, on the other hand.

The fourth end wall form member 200 has an inwardly-facing vertical end face molding surface 201, which faces toward the surface 199 of third end wall form member 198. Thus the U-shaped body portion to be precast between these third and fourth end wall form members can be conveniently designated as the third portal end section 34, and its mold surfaces are adapted to provide an upside-down image of such a third end section which can later be assembled as part of a complete three-piece portal end section by interfitting a subsequently cast second portal end section between the first and third portal end sections for which the already described molds have been provided.

Outer form members 164*a* and 165*a* are positioned along and spaced from the outwardly-facing side walls of the inner form member in the same manner as the outer form members 164 and 165 previously described. Third and fourth bottom form members 203 and 205 have upwardly-facing mold surfaces which close the bottom of the molding space between the inner and outer form members at each side. Vertical support beams 204 (FIG. 27) support the main body portions of these bottom form members, through intermediate base portions 204*a* and vertical connections 204*b*, at the desired slope or vertical angle required to provide a smooth continuation of the upper side wall edges of the successive first, second and third portal end sections when they are ultimately assembled.

Bottom form member 203 (FIG. 27) thus extends upwardly from left to right at the same slope as bottom form member 181 in FIG. 24, but the lower left end of form 203 starts at a higher vertical level than the upper right end of bottom form 181, so that both forms will provide for casting sloping upper side wall edges which are inclined along one common angular line when the three portal end sections are ultimately assembled. The fourth bottom form member 205 (FIG. 22) has an identical slope or vertical angle to that of form 194 (FIG. 26), but the lower end of form 205 starts at a higher vertical level than the upper end of bottom form member 194 (FIG. 26), so that both forms 194 and 205 provide for casting opposite sloping upper side wall edges which are inclined along a common vertical angle which is steeper and shorter than that which is provided by bottom form members 181 and 203 at the other side wall, when the three portal end sections are ultimately assembled.

Thus the mold forms shown and described provide a means for carrying out an effective sequential casting process for desired portal end sections, in which, for example, the first and third body portions of a three-part portal end section can first be precast and removed from the form, after which an intermediate second body portion for such a three-part portal end section can then be cast on the same form, without changing its angular orientation, by positioning the necessary additional form members (fifth and sixth end wall form members, fifth and sixth bottom form members, and fifth and sixth outer form members) to provide a casting space corresponding to an upside-down image of the intermediate second body portion needed for ultimate assembly between the initially-cast first and third body portions. The casting space 207 (FIG. 22) for such intermediate section is readily provided by utilizing the exact area of the inner form member which lies between the planes of the respective outwardly-facing end section of the first body portion and the inwardly-facing end surface of the third body portion, before or after such first and third body portions have been precast and removed from the form.

FIG. 23 further shows in phantom outline how the inner form member, with a wedge-shaped insert 133*a*, can be used to provide a molding space for an oppositely-flared unsymmetrical U-shaped base portion of a portal end section of the type shown at 60 in FIG. 8. In this case an inner end form generally similar to form 167 in FIG. 23 could be positioned across the inner form member in a vertical plane intersecting the top of the inner form member as shown at 209. Such vertical plane extends across the inner form member perpendicularly to outwardly-facing side wall 151, rather than perpendicularly to the opposite outer side wall 154. An outer end wall form member 210 for the vertical outer end face of such a portal end section would then be positioned in a vertical plane parallel to the plane of the inner end face 209 and thus also perpendicular to mold surface 151. These inner and outer end wall form members 209 and 210 will thus intersect the side wall 151 along vertical lines 211 and 212, and will intersect the opposite side wall 154 of the inner form member along corresponding vertical lines at 213 and 214.

Bottom form members generally similar to bottom form members 181 and 194, and opposite outer form members generally similar to forms 164 and 165 can then be added to complete a molding space corresponding to an upside-down image of a U-shaped base portion for a portal end section in which the respective side walls have different lengths and flare angles and thus provide a U-shaped base portion which is flared in an angular unsymmetrical configuration generally opposite to that of the end sections cast as shown in FIG. 22, and at the narrower end of FIG. 23. The same method of casting a first body portion over the narrow end of the inner form, casting a "third" body portion at the exact required spacing from the first body portion, removing the first and third body portions, and then casting the "second" body portion in the exact mold space between the previously used first and second mold spaces, can again be used.

Figure 28:
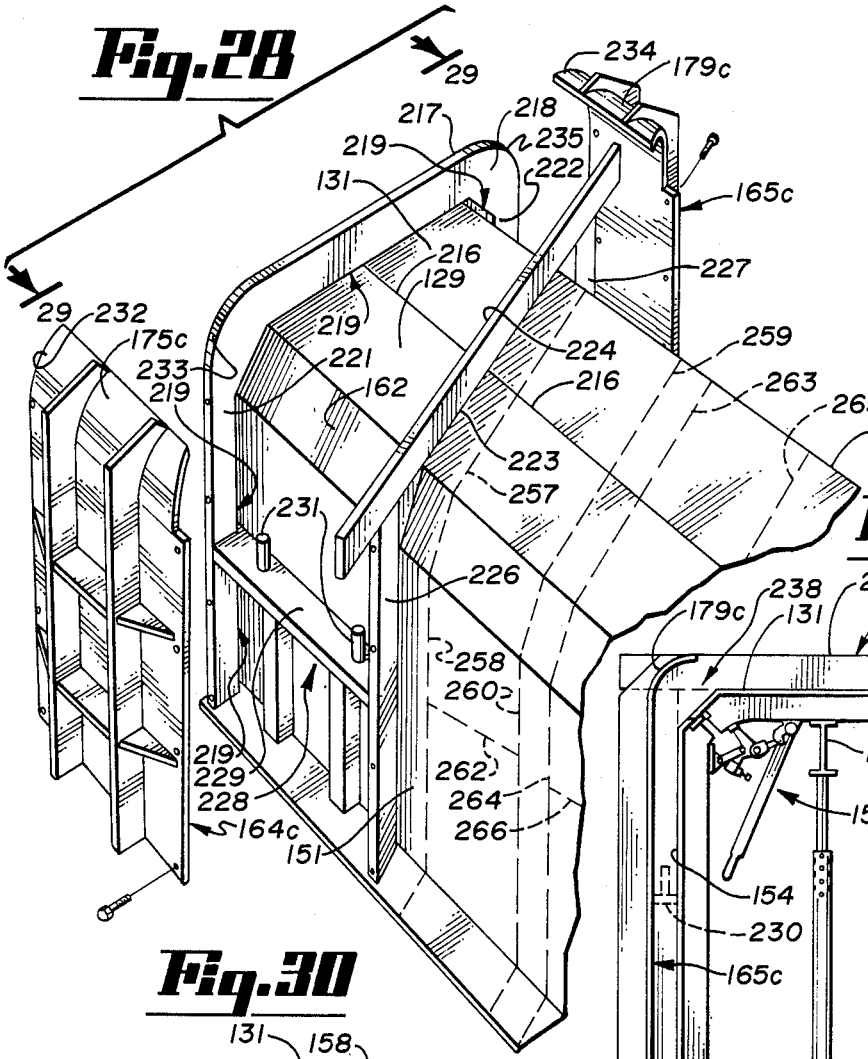
FIG. 28 is a perspective view of the molding apparatus set up with parallel outer side walls for selectively precasting U-shaped body portions for one angular transition section and for a plurality of unsymmetrical portal end sections with skewed parallel sloping side walls.
Figure 29:
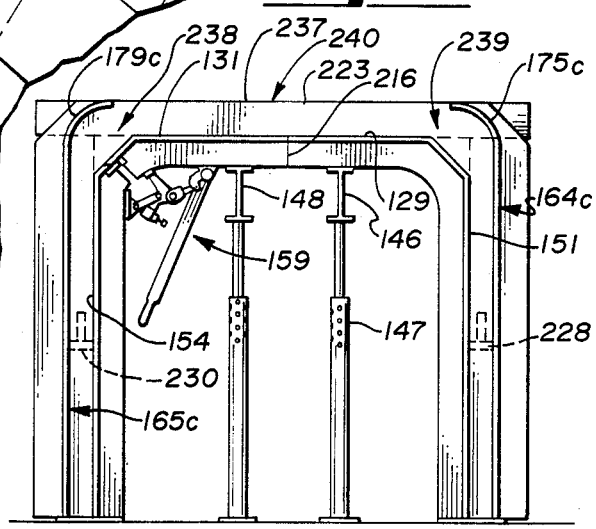
FIG. 29 is an end view of the molding form of FIG. 28, taken along line 29—29 of FIG. 28, with the inner end wall form member omitted for clarity.

FIGS. 28 and 29 show the manner in which the inner form can be selectively positioned or repositioned for use in the casting of unsymmetrical transition sections of the type shown at 68 in FIGS. 5 to 7, and for the casting of unsymmetrical unflared portal end sections 35, as shown in those same figures, or both. In this case, the selectively-insertable wedge section, such as 133 or 133*a*, is omitted, so that the outwardly-facing side walls 151 and 154 are parallel to each other. As shown in FIG. 28, the rectangular longitudinal top surface insert 132 is also omitted, so that the inner edges of top wall sections 129 and 131 directly engage each other along a meeting line or joint 216 and thus provide a narrower inner form member for casting U-shaped body portions for a narrower box culvert. The rectangular section 132 of FIGS. 22 and 23 can be left in the upper surface of the inner mold form without the wedge-shaped section, however, if one desires to cast a transition section for specific assembly with a wider box culvert end of the width for which the portal end sections cast according to FIGS. 22 and 23 are to be used.

In FIG. 28, a first end wall form 217 extends perpendicularly across the end of the inner form member in a vertical plane providing a molding surface for the inner face of a desired transition section, i.e. the face which will be directly connected to an outermost box culvert section. This vertical end wall form includes a recess 219 around the inner form member and provides space for casting an integral projecting tongue 78 adapted for interfitting engagement with a corresponding groove in the outer end face at one end of the box culvert.

If the desired transition section is being placed on an opposite end of such a box culvert, where the final box culvert section has a projecting tongue of its own, the end wall face 218 of the form can be provided with a correspondingly shaped projection into the mold space. Such projection will mold a suitably shaped mating recess within the inner end face of the transition section rather than the corresponding projecting tongue which will be formed by the recess 219 of FIG. 28.

The end wall form member 217 has vertical end wall molding faces 221 and 222 in a common plane with cross face 218, to complete the upside-down image of the inner end face 75 of both the base 71 and side walls 72 and 73 of the U-shaped transition body portion.

A second end wall form 223 extends across the inner form member in a vertical plane which provides a transverse upper molding face 224 facing toward the molding surface 218 of the first end wall form member, but in a plane which is positioned angularly across the inner form member at a desired skew angle. The inner face of molding surface 224 is provided with an inward projection (not shown) adjacent the top surface of the inner form member to provide an upside-down image of the recess 79 to be formed in the upper surface of the outer end face 76 of the transition section bottom wall 71. Such recess 79 is shaped to receive, in interfitting engagement, the inwardly-projecting tongue 52 on the inner face of the adjacent inner portal end section, to insure accurate assembly in registration with the transition section outer end face.

The second (outer) end wall form member 223 for the transition section also has vertical end wall form portions 226 and 227 to provide upside-down molding surfaces for the outer end faces of the side wall portions of the desired U-shaped transition body portion.

A first bottom wall form member 228 extends along the inner form member side wall mold surface 151 between the spaced end wall form portions 221 and 226. This first bottom wall form 228 has a horizontal upper surface 229 which extends horizontally along side wall mold surface 151 and thus provides an upside-down image of the flat horizontal top surface on one upper side wall of the U-shaped transition section body portion.

Bottom form member 228 also includes vertical upwardly-extending cylindrical projections 231 adapted to form vertical recesses in the corresponding top side wall of such a transition section as part of the interfitting connection of a flat lintel beam across the upper side edges of the section.

A second bottom form member similar to bottom form 228 is correspondingly positioned between the vertical end wall mold surfaces of end form portions 222 and 227. Such second bottom form member will be shorter than bottom form 228 to fit the shorter space between the end wall mold forms 222 and 227, but will have its own flat horizontal upper surface at the same vertical height as the surface 229 of form 228, i.e. in a common horizontal plane. Such second bottom form member will also have vertical cylindrical upward projections of similar construction to projections 231, and for a similar purpose.

To complete the mold surface for the transition section, outer side wall form members 164*c* and 165*c*, generally similar to previously-described forms 164 and 165, overlap and are secured to the vertical side edges of the end wall forms 217 and 223. In this case, however, the upper and inwardly-curved portion 175*c* at the top of side wall form 164*c* has a special edge extension 232 which overlaps the curved upper corner 233 of end wall form 217. Thus portion 232 can closely fit over the curved portion 233, rather than fit inside of the first end wall form. The other end of curved portion 175*c* fits just inside the transverse portion 224 of the second end wall form member 223. A similar special edge extension 234 is provided on the inwardly-curved upper portion 179*c* of the other side wall form member 165*c*, and similarly overlaps the curved upper corner 235 of end wall form 217.

With the parts of the mold form assembled as shown in FIGS. 28 and 29, with the side walls 151 and 154 of the inner form member selectively supported on the ground along vertical planes parallel to each other, a mold cavity corresponding to an upside-down image of a preferred U-shaped transition section body portion is provided. As shown in FIG. 29, the top of this mold cavity is open throughout the area 237 which extends transversely between the top inner edges of the curved side wall mold extensions 175*c* and 179*c* and longitudinally between the end wall form members 217 and 223.

The desired precasting process can then be carried out, after providing this arrangement of mold form members, by first pouring a suitable concrete mix downwardly into the upwardly-open mold space defined by the specified mold surfaces of the inner and outer form members, the bottom form members and the end wall form members. The initial pouring of such mix can be directed toward the side wall mold portions as shown by arrows 238 and 239 in FIG. 29. The mold may be vibrated during such pouring to insure complete filling of the side wall mold spaces and avoid the formation of voids therein. Then the method involves the continued pouring of such concrete mix into the open top of the form, until it covers the upwardly-facing top surface of the inner form member to a depth corresponding to the desired thickness for the base of the desired U-shaped body portion.

Next, the upper surface of the poured concrete mix will be finished to a shape corresponding to an upside-down image of the outer bottom wall surface of the desired U-shaped body portion, thereby completing the forming of the U-shaped body portion as an integral precast unit in an upside-down orientation. When this unit has remained on the form long enough for adequate setting and curing, the final step of this precasting method involves the subsequent removal of the precast body portion from the form for inversion to right-side-up position and for later on-site installation at the one culvert end for which it has been designed.

Figure 30:
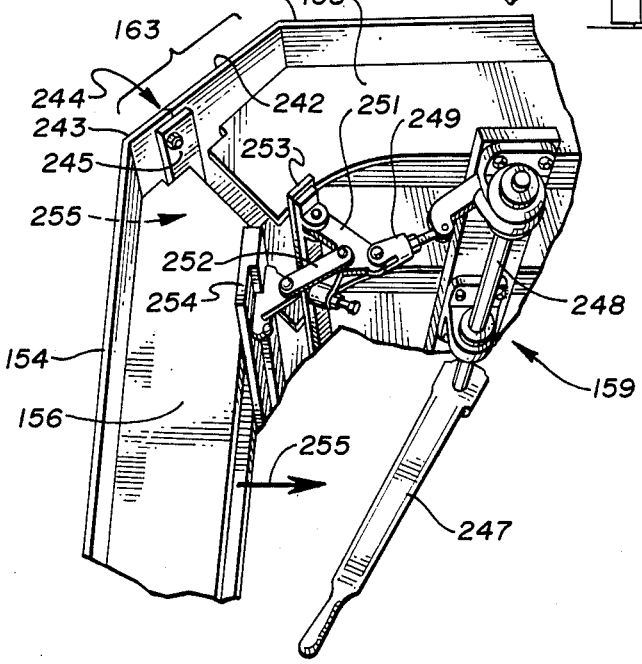
FIG. 30 is a perspective detail of the breakaway mechanism along one side of the inner form member.

Details of the connecting mechanism 159 between the vertical legs 156 of the inner side mold wall supports and the cross flange 158 for the top mold edge 131 are further shown in FIG. 30. An operating handle or wrench 247 is used to rotate a longitudinal actuating shaft 248, after a precast section is sufficiently secured for removal from the mold.

To assist in such removal, the upwardly and outwardly-facing molding surface 163 for the haunch portion of the desired body section has an upper edge portion 242 adjacent and secured to the upper mold surface 131, and a lower edge portion 243 adjacent and secured to the vertical side mold wall 154. These two edge portions 242 and 243 have their edges abutting each other along a separation line 244, when the mold parts are set up in their preselected positions prior to casting. An inner cover plate 245, secured to portion 243, underlaps the upper part 242 of the haunch molding surface 163 when the respective edges 242 and 243 abut each other at the separation line 244.

The parts are held rigidly in the molding position of FIG. 30 by the arrangement of links 249, 251 and 252, with link 251 engaging a bracket 253 secured to the underside of upper flange 158. Link 252 similarly engages a longitudinal bracket 254 secured to the inner edges of the inner side mold flanges 156.

When the precast body portion is to be removed from the mold, the outer side wall forms 164*c* and 165*c*, and the end wall forms 217 and 223 will be removed from the form. Shaft 248 can then be rotated to rock the upper edge of side wall mold surface 154, together with portion 243 of the haunch molding surface, inwardly, in the direction shown by arrow 255. Such limited inward rocking movement helps to release the inside of the precast portal transition section from the mold.

The linkage of mechanism 159 may also provide for limited downward rocking of the bracket 253 and the associated mold edges at the intersection of haunch molding surface 242 and top mold wall 131, in appropriate sequence after the inward rocking of the mold surface 243 with the upper portion of side wall mold surface 154. Such limited downward rocking of surfaces 242 and 131 can further assist in the release of the inner bottom wall of the precast transition section from the upper mold surfaces of the inner form member.

Shaft 248 of mechanism 159 preferably extends only part way along the inner form member. Additional separate mechanisms 159 are positioned along the form member, so that they can be individually operated in any desired sequence to insure smooth release of the upside-down U-shaped body portions from the form.

As further shown in dotted outline in FIG. 28, the selective positioning or repositioning of the inner mold form so that its side walls 151 and 154 are parallel to each other provides a suitable arrangement and an adequate longitudinally extending inner form member for the concurrent precasting of 1 or more portal end sections with unsymmetrically parallel side walls of the type shown at 35 in FIGS. 5 to 7, in addition to a suitable transition section.

For this purpose, a further inner end wall form 257, shown schematically in phantom outline, can be positioned in a vertical plane extending across the inner form member and parallel to the angularly skewed outer end form member 223 for the transition section mold cavity just described. Inner end wall form 257 has vertical end portions 258 extending downwardly along each side wall of the inner form member.

A transverse outer end wall form 259, in a vertical plane parallel to and spaced outwardly along the form from the inner end wall form 257, 258, also has vertical end portions 260 extending down along the opposite side walls of the inner form member. Sloping bottom form members 262 extend along opposite side walls of the inner form member at vertical angles designed to fit the expected fill slope plane when the portal end section cast between such additional end wall forms 257 and 259 is positioned at the culvert site. In this special case, where the side walls of the U-shaped portal end section are being cast along an inner form member which is oriented with parallel side mold surfaces, and in view of the fact that the inner end face of such a first portal end section 35 is intended to be oriented in a vertical plane parallel to the longitudinal embankment axis, the slope angles and lengths of the respective parallel upper edges at each side of the unsymmetrical portal end section form should be made of identical length to each other and inclined at the same vertical angle along the planes of the side walls. Such angles will not, however, equal the fill slope angle, since both of the parallel side walls of the portal end section will be oriented at the intended skew angle with respect to a reference plane such as 31, perpendicular to the longitudinal embankment axis. Thus the bottom form members 262 will be slightly longer and will be inclined at a slightly smaller vertical angle than the fill slope angle which would be needed, if these side walls were actually to be oriented in vertical planes perpendicular to the longitudinal embankment axis, i.e. in the same planes in which the fill slope angle, as defined herein, is measured.

An identical, similarly unsymmetrical second portal end section can also be precast prior to curing and removal of the transition end section and the first portal end section, when the inner form member is constructed and oriented as shown in FIG. 28. Thus another transverse inner end wall form 263, with vertical portions such as 264, may be positioned beyond the end wall form 259 and facing toward the outer end of the inner form member. Similarly, a further outer end wall form 265 can be supported in a similar vertical plane parallel to that of inner end wall form 263, and bottom form members 266 may be positioned along the sides of the inner form member between the inner and outer end wall forms 263 and 265. Such bottom form members 266 on opposite sides of the inner form member, will be identical to each other, and will also have the same longitudinal vertical angle along the inner form member as the bottom form members 262 for the first portal end section. In this case, however, the vertical points where the inner or lower ends of bottom form members 266 intersect the inner end wall form 263 will be at the same vertical level as the higher outer ends of the bottom form members 262 of the first end section.

By providing an inner form member of sufficient length, the form can continue at 268 for whatever additional length may be needed or desired for the precasting of additional portal end sections, as well as the portal transition section which is precast as previously described, between the first inner and outer end forms 217 and 223.

The foregoing description sets forth the preferred embodiments and modifications of the present invention and some of the ways in which the invention may be put into practice. Thus the invention makes it possible to provide portal assemblies which can fit a variety of different design parameters as to skew angles and flare angles, without having to build a separate form for each different configuration. The molding forms and methods of the invention are particularly useful for the precasting of unsymmetrical portal transition sections and unsymmetrical portal end sections which can be combined for installation as parts of complete portal assemblies at one end or both ends of a skewed box culvert.

It will be understood that the portal assembly sections of the present invention will include appropriate steel reinforcing materials, such as steel rods and/or steel mesh material, to strengthen such concrete sections in known manner.

In reading the foregoing description and the following claims, it should be noted that references to "first", "second", etc. in the claims are intended for convenient understanding of the sequence in which a specific claim refers to plural elements of a given type, and that such references may not always correspond exactly to the successive designations of such elements as used in the foregoing description. It will also be understood that references to an extension or installation at one end of a box culvert are intended to apply to either the inlet end or the outlet end of such a box culvert, unless there is a specific indication to the contrary. The economical methods of repositioning and adjustment of the molding forms as described herein, to produce a large variety of different transition sections and portal end sections for combination in portal assemblies with different sizes, skew angles and flare angles, and in which the upper edges of different side walls of unsymmetrical portal end sections can be precast with selectively different slopes, as needed to match a given fill slope plane, are facilitated by the molding form structures described, and particularly by such features as the provision of bottom form members with selectively attachable end extensions for different lengths and slope angles, and the provision of the selective rectangular and wedge-shaped inserts for the upwardly-facing top surface of the inner form member. Such inserts can be provided to accommodate skew angles of 15 degrees or less, and as much as 30 degree or even more, and a similar range of unsymmetrical portal end section flare angles.

Also, the desired fill slope angles are often specified by a vertical to horizontal ratio such as 1 to 2, but other angles may be predetermined or expected at a particular culvert site.

Thus further modifications of the described embodiments, as well as alternate embodiments, devices and methods for carrying out the described inventions may also be apparent to those skilled in the art, within the spirit and scope of the following claims.

I claim:

1. A molding form for selectively precasting sections for a portal assembly to be connected at one end of a box culvert of the type which provides a bottom wall, side walls and a top wall for a generally crosswise stream passage under an embankment which extends along a longitudinal axis and which has a laterally outwardly and downwardly inclined fill slope defining a fill slope plane at a desired vertical fill slope angle as measured in a vertical plane perpendicular to such longitudinal embankment axis, and in which each such section, when installed at said one box culvert end, has a precast U-shaped body portion in which the base of such U provides a bottom wall surface for the desired stream passage and the arms of such U extend upwardly from said base and provide side walls at each side of said stream passage, said molding form comprising:

an inner form member having respective upwarldy-facing and oppositely outwardly-facing top and side wall mold surfaces corresponding respectively to upside-down images of the inner bottom wall and opposite inner side wall surfaces of at least one such desired U-shaped body portion, for precasting such a body portion as a monolithic unit in upside-down position above the top mold wall surface and down along the opposite side mold wall surfaces of said inner form member;

at least two outer side wall form members supported in respective positions extending along and spaced outwardly from the opposite outwardly-facing mold wall surfaces of the inner form member and having inwardly-facing side wall mold surfaces corresponding to upside-down images of the outer side wall surfaces of the desired U-shaped body portion;

at least two bottom form members having upwardly-facing top wall mold surfaces extending along and closing lower portions of the molding form between the inner and outer form members at the respective opposite sides of said inner form, and corresponding to upside-down images of the upper edges of the side walls of the desired U-shaped body portion; and at least two end wall form members for selective assembly across said upwardly-facing top mold wall surface and vertically down across the space between said outwardly-facing side wall surfaces of said inner form member and said inwardly-facing side mold wall surfaces of the outer side wall form members, said end form members having respective end wall mold surfaces corresponding to upside-down images of the opposite inner and outer end faces of such desired U-shaped body portion;

the upper portion of the molding form above the upwardly-facing top mold wall surface of the inner form member and between the mold wall surfaces of the respective outer side wall form members and the end wall form members providing an upwardly open end area through which a concrete mix can be fed downwardly between the inner and outer side mold wall surfaces and across the top mold wall surface of the inner form member, where the top portion of the mix can be finished off to a depth and shape corresponding to an upside-down image of the desired outer bottom surface of the desired U-shaped body portion, the upwardly-facing top wall mold surfaces of said bottom form members corresponding respectively to upside-down images of the edge surfaces of the desired U-shaped body portion side walls and extending longitudinally of the mold form at vertical distances below the upwardly-facing top wall mold surface and at vertical angles corresponding to the upside-down images of the desired vertical heights and slopes of the respective U-shaped body portion side wall upper edges above the inner bottom wall surface of such body portion, the upwardly-facing top mold wall surface of the inner form member comprising at least one selectively insertable and removable insert section for changing one of the effective shape and width characteristics of the top mold wall surface of the inner form member corresponding to an upside-down image of one of the desired shape and width characteristics of the desired U-shaped body portion to be cast in inverted position thereon, the oppositely outwardly-facing side mold wall surfaces of the inner form member having individual supporting means for selectively supporting them in first relative positions parallel to each other and perpendicular to a vertical plane at one end of the inner form member, and in a selected one of a plurality of alternate relative positions in which the side mold wall surfaces are oriented in vertical planes which diverge from each other from said one end of the inner form member toward the other end of said form.

2. A molding form according to claim 1 in which one selectively insertable and removable insert section for the top mold wall surface of the inner form member is a horizontal wedge-shaped section having side edges diverging outwardly from each other at an angle corresponding to a selected one of said alternate relative positions of said inner form side wall surfaces, the top mold wall surface of the inner form member including first and second top edge portions extending along the tops of the respective oppositely outwardly-facing side mold wall surfaces asnd extending transversely toward each other, and said top mold wall edge portions having inner edges adapted for selective removable connection to corresponding edges of said wedge-shaped section.

3. A molding form according to claim 1 in which one selectively insertable and removable insert section for the top mold wall surface of the inner form member is a horizontal rectangularly shaped section having side edges parallel to each other from said one end of the inner form member toward the other end of said form, in which said parallel side edges have connecting means for selectively holding said insert section in the top wall mold surface of the inner form member, in which the top mold wall surface includes first and second edge portions extending along the tops of the respective oppositely outwardly facing side mold wall surfaces and extending transversely toward each other, and in which said edge portions have inner edges with cooperating connecting means adapted for selective removable connection to the connecting means at the corresponding parallel edges of said rectangularly-shaped section.

4. A molding form for selectively precasting sections for a portal assembly to be connected at one end of a box culvert of the type which provides a bottom wall, side walls and a top wall for a generally crosswise stream passage under an embankment which extends along a longitudinal axis and which has a laterally outwardly and downwardly inclined fill slope defining a fill slope plane at a desired vertical fill slope angle as measured in a vertical plane perpendicular to such longitudinal embankment axis, and in which each such section, when installed at said one box culvert end, has a precast U-shaped body portion in which the base of such U provides a bottom wall surface for the desired stream passage and the arms of each U extend upwardly from said base and provide side walls at each side of said stream passage, said molding form comprising:

an inner form member having respective upwardly-facing and oppositely outwardly-facing top and side wall mold surfaces corresponding respectively to upside-down images of the inner bottom wall and opposite inner side wall surfaces of at least one such desired U-shaped body portion, for precasting such a body portion as a monolithic unit in upside-down position above the top mold wall surface and down along the opposite side mold wall surfaces of said inner form member;

at least two outer side wall form members supported in respective positions extending along and spaced outwardly from the opposite outwardly-facing mold wall surfaces of the inner form member and having inwardly-facing side wall mold surfaces corresponding to upside-down images of the outer side wall surfaces of the desired U-shaped body portion;

at least two bottom form members having upwardly-facing top wall mold surfaces extending along and closing lower portions of the molding form between the inner and outer form members at the respective opposite sides of said inner form, and corresponding to upside-down images of the upper edges of the side walls of the desired U-shaped body portion;

at least two end wall form members for selective assembly across said upwardly-facing top mold wall surface and vertically down across the space between said outwardly-facing side wall surfaces of said inner form member and said inwardly-facing side mold wall surfaces of the outer side wall form members, said end form members having respective end wall mold surfaces corresponding to upside-down images of the opposite inner and outer end faces of such desired U-shaped body portion;

the upper portion of the molding form above the upwardly-facing top mold wall surface of the inner form member and between the mold wall surfaces of the respective outer side wall form members and the end wall form members providing an upwardly open top area through which a concrete mix can be fed downwardly between the inner and outer side mold wall surfaces and across the top mold wall surface of the inner form member, where the top portion of the mix can be finished off to a depth and shape corresponding to an upside-down image of the desired outer bottom surface of the desired U-shaped body portion; and the upwardly-facing top mold wall surface of the inner form member being rectangular in shape and the oppositely outwardly facing side mold wall surfaces being parallel to each other; and wherein one of said end wall form members is a first end wall form member extending across one end of the inner form member in a vertical plane perpendicular to the parallel side mold wall surfaces, and another of said end wall form members is a second oppositely-facing end wall form member extending across the inner form member in a vertical plane at a desired distance from the first end wall form member and at a desired nonparallel transverse orientation with reference to the plane of the first end wall member, said molding form thereby providing for the upside-down casting of a portal assembly transition section having a first inner end face matching one end of a box culvert section and providing side walls of respectively different lengths as straight line extensions of the side walls of such culvert section, and said form further providing an outer face on such transition section in a vertical plane at said desired nonparallel transverse orientation relative to said inner end face.

5. A molding form for selectively precasting sections for a portal assembly to be connected at one end of a box culvert of the type which provides a bottom wall, side walls and a top wall for a generally crosswise stream passage under an embankment which extends along a longitudinal axis and which has a laterally outwardly and downwardly inclined fill slope plane at a desired fill slope angle as measured in a vertical plane perpendicular to such longitudinal embankment axis, and in which each such section, when installed at said one box culvert end, has a precast U-shaped body portion in which the base of such U provides a bottom wall surface for the desired stream passage and the arms of each U extend upwardly from said base and provide side walls at each side of said stream passage, said molding form comprising:

an inner form member having respective upwardly-facing and oppositely outwardly-facing top and side wall mold surfaces corresponding respectively to upside-down images of the inner bottom wall and opposite inner side wall surfaces of at least one such desired U-shaped body portion as a monolithic unit in upside-down position above the top mold wall surface and down along the opposite side mold wall surfaces of said inner form member;

at least two outer side wall form members supported in respective positions extending along and and spaced outwardly from the opposite outwardly-facing mold wall surfaces of the inner form member and having inwardly-facing side wall mold surfaces corresponding to upside-down images of the outer side wall surfaces of the desired U-shaped body portion;

at least two bottom form members having upwardly-facing top wall mold surfaces extending along and closing lower portions of the molding form between the inner and outer form members at the respective opposite sides of said inner form, and corresponding to upside-down images of the upper edges of the side walls of the desired U-shaped body portion;

at least two end wall form members for selective assembly across said upwardly-facing top mold wall surface and vertically down across the space between said outwardly-facing side wall surfaces of said inner form member and said inwardly-facing side mold wall surfaces of the outer side wall form members, said end form members having respective end wall mold surfaces corresponding to upside-down images of the opposite inner and outer end faces of such desired U-shaped body portion;

the upper portion of the molding form above the upwardly-facing top mold wall surface of the inner form member and between the mold wall surfaces of the respective outer side wall form members and the end wall form members providing an upwardly open top area through which a concrete mix can be fed downwardly between the inner and outer side mold wall surfaces and across the top mold wall surface of the inner form member, where the top portion of the mix can be finished off to a depth and shape corresponding to an upside-down image of the desired outer bottom surface of the desired U-shaped body portion; and the upwardly-facing top mold wall surface of the inner form member being rectangular in shape and the oppositely outwardly-facing side mold wall surfaces being parallel to each other; and wherein said at least two end wall form members are parallel and have respective end wall mold surfaces facing each other for molding the inner and outer end faces of a U-shaped body portion for an unsymmetrical culvert portal section, said end wall form members extending across the inner form member in nonperpendicular transverse vertical planes with reference to the parallel side wall mold surfaces.

6. A molding form according to claim 5 in which the inner form member has a length for cooperation with a number of pairs of end wall form members and with similarly inclined bottom form members of different vertical position below the top of said inner form member for simultaneous casting of a plurality of U-shaped body portions for end-to-end assembly to constitute a complete portal section which, when inverted for installation, will have continuously sloping upper side wall edges fitting the desired fill slope plane at the site of installation.

7. A molding form for selectively precasting sections for a portal assembly to be connected at one end of a box culvert of the type which provides bottom wall, side walls and a top wall for a generally crosswise stream passage under an embankment which extends along a longitudinal axis and which has a laterally outwardly and downwardly inclined fill slope defining a fill slope plane at a desired vertical fill slope angle as measured in a vertical plane perpendicular to such longitudinal embankment axis, and in which each such section, when installed at said one box culvert end, has a precast U-shaped body portion in which the base of such U provides a bottom wall surface for the desired stream passage and the arms of such U extend upwardly from said base and provide side walls at each side of said stream passage, said molding form comprising:

an inner form member having respective upwardly-facing and oppositely outwardly-facing top and side wall mold surfaces corresponding respectively to upside-down images of the inner bottom wall and opposite inner side wall surfaces of at least one such desired U-shaped body portion, for precasting such a body portion as a monolithic unit in upside-down position above the top mold wall surface and down along the opposite side mold wall surfaces of said inner form member;

at least two outer side wall form members supported in respective positions extending along and spaced outwardly from the opposite outwardly-facing mold wall surfaces of the inner form member and having inwardly-facing side wall mold surfaces corresponding to upside-down images of the outer side wall surfaces of the desired U-shaped body portion;

at least two bottom form members having upwardly-facing top wall mold surfaces extending along and closing lower portions of the molding form between the inner and outer form members at the respective opposite sides of said inner form, and corresponding to upside-down images of the upper edges of the side walls of the desired U-shaped body portion; and at least two end wall form members for selective assembly across said upwardly-facing top mold wall surface and vertically down across the space between said outwardly-facing side wall surfaces of said inner form member and said inwardly-facing side mold wall surfaces of the outer side wall form members, said end form members having respective end wall mold surfaces corresponding to upside-down images of the opposite inner and outer end faces of such desired U-shaped body portion;

the upper portion of the molding form above the upwardly-facing top mold wall surface of the inner form member and between the mold wall surfaces of the respective outer side wall form members and the end wall form members providing an upwardly open top area through which a concrete mix can be fed downwardly between the inner and outer side mold wall sufaces and across the top mold wall surface of the inner form member, where the top portion of the mix can be finished off to a depth and shape corresponding to an upside-down image of the desired outer bottom surface of the desired U-shaped body portion, the upwardly-facing top wall mold surfaces of said bottom form members corresponding respectively to upside-down images of the edge surfaces of the desired U-shaped body portion side walls and extending longitudinally of the mold form at vertical distances below the upwardly-facing top wall mold surface and at vertical angles corresponding to the upside-down images of the desired vertical heights and slopes of the respective U-shaped body portion side wall upper edges above the inner bottom wall surface of such body portion, the upwardly-facing top mold wall surface of the inner form member comprising at least one selectively insertable and removable insert section for changing one of the effective shape and width characteristics of the top mold wall surface of the inner form member corresponding to an upside-down image of one of the desired shape and width characteristics of the desired U-shaped body portion to be cast in inverted position thereon, the oppositely outwardly-facing side wall mold surfaces of the inner form member having individual supporting means for selectively supporting them in a selected one of a plurality of alternate relative positions in which the side wall mold surfaces are oriented in vertical planes which diverge from each other from one end of the inner form member toward the opposite end of such inner form member.

8. A molding form according to claim 7 having a plurality of horizontal wedge-shaped sections, each of said wedge-shaped sections having respective side edges diverging outwardly from each other and connecting means at the respective wedge-shaped section side edges for selective connection and removal of any one of said wedge-shaped sections as part of the upwardly-facing mold surface of the inner form member for precasting a desired U-shaped body portion with side walls diverging from each other.

9. A molding form according to claim 8 in which the first and second end wall form members extend laterally across the inner and outer form members with their respective end wall mold surfaces positioned in vertical planes which are parallel to each other and which intersect the respective outwardly-facing side wall mold surfaces of the inner form member at respectively different horizontal angles.

10. A molding form according to claim 9 in which the two bottom form members extend along opposite sides of the inner form member from the first end wall mold face to the second end wall mold face at respectively different vertical angles and have respectively different lengths and provide molding surfaces corresponding to upside-down images of the upper edges of the side walls of desired unsymmetrical portal end sections in which such side wall upper edges are positioned unsymmetrically with respect to a vertical plane perpendicular to the expected longitudinal embankment axis, but in which said different vertical angles and different lengths of the upper side wall edges insure the accurate positioning of each such side wall edge in a common plane corresponding to such fill slope plane.

* * * * *